US011419201B2

(12) United States Patent
Bessems et al.

(10) Patent No.: US 11,419,201 B2
(45) Date of Patent: Aug. 16, 2022

(54) SYSTEMS AND METHODS FOR PROVIDING DYNAMIC LIGHTING

(71) Applicant: IDEAL Industries Lighting LLC, Sycamore, IL (US)

(72) Inventors: Ronald W. Bessems, Celebration, FL (US); Matthew Brian Deese, Raleigh, NC (US); Kory Alexander Liszt, Apex, NC (US); John W. Frailey, Cary, NC (US); Shane Michael O'Donnell, Raleigh, NC (US); Ronald Lee Fienberg, Cary, NC (US); Thomas Richard Hinds, Apex, NC (US); Gary David Trott, Eatonton, GA (US)

(73) Assignee: IDEAL Industries Lighting LLC, Sycamore, IL (US)

( * ) Notice: Subject to any disclaimer, the term of this patent is extended or adjusted under 35 U.S.C. 154(b) by 0 days.

(21) Appl. No.: 17/082,767

(22) Filed: Oct. 28, 2020

(65) Prior Publication Data

US 2021/0127475 A1 Apr. 29, 2021

Related U.S. Application Data

(60) Provisional application No. 62/926,862, filed on Oct. 28, 2019.

(51) Int. Cl.

*H05B 47/17* (2020.01)
*H05B 47/175* (2020.01)
*H05B 47/165* (2020.01)

(52) U.S. Cl.

CPC ..... *H05B 47/17* (2020.01); *H05B 47/165* (2020.01); *H05B 47/175* (2020.01)

(58) Field of Classification Search

CPC .... H05B 47/17; H05B 47/165; H05B 47/175; H05B 47/115; H05B 47/155; Y02B 20/40

See application file for complete search history.

(56) References Cited

U.S. PATENT DOCUMENTS 4,679,086 A 7/1987 May
6,185,444 B1 2/2001 Ackerman et al.
(Continued)

FOREIGN PATENT DOCUMENTS

CN 104782229 A 7/2015
CN 105874270 A 8/2016
(Continued)

OTHER PUBLICATIONS

International Search Report and Written Opinion for International Patent Application No. PCT/US2020/057706, dated Feb. 9, 2021, 19 pages.

(Continued)

*Primary Examiner* — Daniel D Chang
(74) *Attorney, Agent, or Firm* — Withrow & Terranova, P.L.L.C.

(57) ABSTRACT

Systems and methods for providing dynamic lighting are provided. In an exemplary aspect, one or more characteristics of light provided from a lighting device or a group of lighting devices changes over time to shape the environment of an indoor space according to dynamic lighting instructions. Dynamic lighting may improve the health or wellbeing of individuals in an indoor space, for example, by simulating an outdoor environment to reduce stress, by providing circadian entrainment to improve sleep and wakefulness, or the like. Other aspects of the present disclosure enable lighting devices to provide light that is synchronized with one or more other devices and does not significantly drift over time so that the lighting devices can provide seamless dynamic lighting experiences that shape the environment of an indoor space.

20 Claims, 18 Drawing Sheets

(56) References Cited

U.S. PATENT DOCUMENTS

| | | | |
|---|---|---|---|
| 6,470,453 | B1 | 10/2002 | Vilhuber |
| 6,647,426 | B2 | 11/2003 | Mohammed |
| 7,344,279 | B2 | 3/2008 | Mueller et al. |
| 8,035,320 | B2 | 10/2011 | Sibert |
| 9,030,103 | B2 | 5/2015 | Pickard |
| 9,039,746 | B2 | 5/2015 | van de Ven et al. |
| 9,155,165 | B2 | 10/2015 | Chobot |
| 9,456,482 | B1 | 9/2016 | Pope et al. |
| 9,488,327 | B2 | 11/2016 | Van Gheluwe et al. |
| 9,681,510 | B2 | 6/2017 | van de Ven |
| 9,686,477 | B2 | 6/2017 | Walters et al. |
| 9,706,617 | B2 | 7/2017 | Carrigan et al. |
| 9,710,691 | B1 | 7/2017 | Hatcher et al. |
| 9,730,289 | B1 | 8/2017 | Hu et al. |
| 9,769,900 | B2 | 9/2017 | Underwood et al. |
| 9,826,598 | B2 | 11/2017 | Roberts et al. |
| 9,888,546 | B2 | 2/2018 | Deese et al. |
| 9,894,740 | B1 | 2/2018 | Liszt et al. |
| 10,165,650 | B1 | 12/2018 | Fini et al. |
| 10,203,103 | B2 | 2/2019 | Bendtsen et al. |
| 10,781,984 | B2 | 9/2020 | Keller et al. |
| 2005/0128751 | A1 | 6/2005 | Roberge et al. |
| 2006/0002110 | A1 | 1/2006 | Dowling et al. |
| 2006/0022214 | A1 | 2/2006 | Morgan et al. |
| 2006/0071780 | A1 | 4/2006 | McFarland |
| 2006/0074494 | A1 | 4/2006 | McFarland |
| 2006/0095170 | A1 | 5/2006 | Yang et al. |
| 2007/0061050 | A1 | 3/2007 | Hoffknecht |
| 2008/0125161 | A1 | 5/2008 | Ergen et al. |
| 2008/0218334 | A1 | 9/2008 | Pitchers et al. |
| 2008/0273754 | A1 | 11/2008 | Hick et al. |
| 2009/0010178 | A1 | 1/2009 | Tekippe |
| 2009/0045971 | A1 | 2/2009 | Simons et al. |
| 2009/0066473 | A1 | 3/2009 | Simons |
| 2009/0262189 | A1 | 10/2009 | Marman |
| 2009/0290765 | A1 | 11/2009 | Ishii et al. |
| 2010/0182294 | A1 | 7/2010 | Roshan et al. |
| 2010/0189011 | A1 | 7/2010 | Jing et al. |
| 2010/0226280 | A1 | 9/2010 | Burns et al. |
| 2010/0231131 | A1 | 9/2010 | Anderson |
| 2010/0262296 | A1 | 10/2010 | Davis et al. |
| 2010/0295946 | A1 | 11/2010 | Reed et al. |
| 2011/0007168 | A1 | 1/2011 | Nagara et al. |
| 2011/0031897 | A1 | 2/2011 | Henig et al. |
| 2011/0057581 | A1 | 3/2011 | Ashar et al. |
| 2011/0169413 | A1 | 7/2011 | Wendt et al. |
| 2011/0199004 | A1 | 8/2011 | Henig et al. |
| 2011/0211758 | A1 | 9/2011 | Joshi et al. |
| 2012/0038281 | A1 | 2/2012 | Verfuerth |
| 2012/0143357 | A1 | 6/2012 | Chemel et al. |
| 2012/0146518 | A1 | 6/2012 | Keating et al. |
| 2012/0235579 | A1 | 9/2012 | Chemel et al. |
| 2012/0320626 | A1 | 12/2012 | Quilici et al. |
| 2013/0051806 | A1 | 2/2013 | Quilici et al. |
| 2013/0182906 | A1 | 7/2013 | Kojo et al. |
| 2013/0221203 | A1 | 8/2013 | Barrilleaux |
| 2013/0257292 | A1 | 10/2013 | Verfuerth et al. |
| 2013/0293877 | A1 | 11/2013 | Ramer et al. |
| 2013/0307419 | A1 | 11/2013 | Simonian et al. |
| 2014/0001963 | A1 | 1/2014 | Chobot et al. |
| 2014/0028199 | A1 | 1/2014 | Chemel |
| 2014/0028200 | A1 | 1/2014 | Van Wagoner et al. |
| 2014/0062312 | A1 | 3/2014 | Reed |
| 2014/0070724 | A1 | 3/2014 | Gould et al. |
| 2014/0072211 | A1 | 3/2014 | Kovesi et al. |
| 2014/0103833 | A1 | 4/2014 | Ho et al. |
| 2014/0135017 | A1 | 5/2014 | Hirano et al. |
| 2014/0159577 | A1 | 6/2014 | Manoukis et al. |
| 2014/0167653 | A1 | 6/2014 | Chobot |
| 2014/0211985 | A1 | 7/2014 | Polese et al. |
| 2014/0217261 | A1 | 8/2014 | De Groot et al. |
| 2014/0266916 | A1 | 9/2014 | Pakzad et al. |
| 2014/0266946 | A1 | 9/2014 | Bily et al. |
| 2014/0267703 | A1 | 9/2014 | Taylor et al. |
| 2014/0340570 | A1 | 11/2014 | Meyers et al. |
| 2015/0008831 | A1 | 1/2015 | Carrigan et al. |
| 2015/0084503 | A1 | 3/2015 | Liu et al. |
| 2015/0097975 | A1 | 4/2015 | Nash et al. |
| 2015/0195855 | A1 | 7/2015 | Liu |
| 2015/0208490 | A1 | 7/2015 | Bishop et al. |
| 2015/0226392 | A1 | 8/2015 | Gould et al. |
| 2015/0245451 | A1 | 8/2015 | Sung et al. |
| 2015/0264779 | A1 | 9/2015 | Olsen et al. |
| 2015/0264784 | A1 | 9/2015 | Romano |
| 2015/0296599 | A1 | 10/2015 | Recker et al. |
| 2015/0305119 | A1 | 10/2015 | Hidaka et al. |
| 2015/0309174 | A1 | 10/2015 | Giger |
| 2015/0351169 | A1 | 12/2015 | Pope et al. |
| 2015/0370848 | A1 | 12/2015 | Yach et al. |
| 2015/0373808 | A1 | 12/2015 | Kuo et al. |
| 2016/0069978 | A1 | 3/2016 | Rangarajan et al. |
| 2016/0095189 | A1 | 3/2016 | Vangeel et al. |
| 2016/0100086 | A1 | 4/2016 | Chien |
| 2016/0112870 | A1 | 4/2016 | Pathuri |
| 2016/0124081 | A1 | 5/2016 | Charlot et al. |
| 2016/0192458 | A1 | 6/2016 | Keith |
| 2016/0195252 | A1 | 7/2016 | Wilcox et al. |
| 2016/0205749 | A1 | 7/2016 | Creusen et al. |
| 2016/0212830 | A1 | 7/2016 | Erdmann et al. |
| 2016/0227618 | A1 | 8/2016 | Meerbeek et al. |
| 2016/0270179 | A1 | 9/2016 | Ryhorchuk et al. |
| 2016/0273723 | A1 | 9/2016 | Van Gheluwe et al. |
| 2016/0282126 | A1 | 9/2016 | Watts et al. |
| 2016/0286619 | A1 | 9/2016 | Roberts et al. |
| 2017/0013697 | A1 | 1/2017 | Engelen et al. |
| 2017/0048952 | A1 | 2/2017 | Roberts et al. |
| 2017/0086273 | A1* | 3/2017 | Soler ..... H05B 47/16 |
| 2017/0094750 | A1 | 3/2017 | Chen |
| 2017/0167708 | A1 | 6/2017 | Kim et al. |
| 2017/0185057 | A1 | 6/2017 | Ashdown et al. |
| 2017/0228874 | A1 | 8/2017 | Roberts |
| 2017/0230364 | A1 | 8/2017 | Barile et al. |
| 2017/0231045 | A1 | 8/2017 | Hu et al. |
| 2017/0231060 | A1 | 8/2017 | Roberts et al. |
| 2017/0231061 | A1 | 8/2017 | Deese et al. |
| 2017/0231066 | A1 | 8/2017 | Roberts et al. |
| 2017/0257925 | A1 | 9/2017 | Forbis et al. |
| 2017/0366970 | A1 | 12/2017 | Yu |
| 2018/0216791 | A1 | 8/2018 | Leung et al. |
| 2018/0246270 | A1 | 8/2018 | Di Trapani et al. |
| 2018/0252374 | A1 | 9/2018 | Keller et al. |
| 2018/0259140 | A1 | 9/2018 | Keller et al. |
| 2018/0318602 | A1* | 11/2018 | Ciccarelli ..... H05B 47/17 |
| 2018/0359838 | A1 | 12/2018 | Liszt et al. |
| 2019/0242539 | A1 | 8/2019 | Roberts |
| 2019/0340306 | A1 | 11/2019 | Harrison et al. |

FOREIGN PATENT DOCUMENTS

| | | | |
|---|---|---|---|
| DE | 102009016918 | A1 | 10/2010 |
| DE | 202014104825 | U1 | 1/2016 |
| DE | 102014115082 | A1 | 4/2016 |
| EP | 2709428 | A2 | 3/2014 |
| EP | 2918901 | A1 | 9/2015 |
| FR | 3024898 | A1 | 2/2016 |
| JP | 2010141663 | A | 6/2010 |
| JP | 2012243206 | A | 12/2012 |
| JP | 2016051608 | A | 4/2016 |
| WO | 03067934 | A2 | 8/2003 |
| WO | 2009011898 | A2 | 1/2009 |
| WO | 2010004514 | A1 | 1/2010 |
| WO | 2012143814 | A1 | 10/2012 |
| WO | 2013121342 | A2 | 8/2013 |
| WO | 2013158955 | A1 | 10/2013 |
| WO | 2014147524 | A1 | 9/2014 |
| WO | 2015103482 | A1 | 7/2015 |
| WO | 2017045885 | A1 | 3/2017 |

OTHER PUBLICATIONS

Decision on Appeal for U.S. Appl. No. 15/192,308, mailed May 20, 2020, 8 pages.

(56) References Cited

OTHER PUBLICATIONS

Non-Final Office Action for U.S. Appl. No. 16/259,491, dated Feb. 20, 2020, 8 pages.
Notice of Allowance for U.S. Appl. No. 16/259,491, dated Jun. 1, 2020, 7 pages.
Notice of Allowance for U.S. Appl. No. 15/972,176, dated Jun. 19, 2019, 8 pages.
Notice of Allowance for U.S. Appl. No. 16/657,294, dated May 8, 2020, 8 pages.
Notice of Allowance for U.S. Appl. No. 15/972,178, dated Jun. 17, 2019, 9 pages.
Examination Report for European Patent Application No. 17705540.7, dated Jul. 26, 2019, 8 pages.
Summons to Attend Oral Proceedings for European Patent Application No. 17705540.7, mailed Feb. 20, 2020, 9 pages.
Result of Consultation for European Patent Application No. 17705540.7, dated Jul. 31, 2020, 11 pages.
Examination Report for European Patent Application No. 17708904.2, dated Aug. 2, 2019, 9 pages.
Summons to Attend Oral Proceedings for European Patent Application No. 17708904.2, mailed Feb. 20, 2020, 10 pages.
Result of Consultation for European Patent Application No. 17708904.2, dated Aug. 20, 2020, 18 pages.
International Preliminary Report on Patentability for International Patent Application No. PCT/US2018/037048, dated Dec. 26, 2019, 9 pages.
International Search Report and Written Opinion for PCT/US2019/016592, dated Apr. 17, 2019, 16 pages.
International Preliminary Report on Patentability for PCT/US2019/016592, dated Aug. 20, 2020, 9 pages.
Berclaz, J., et al., "Robust People Tracking with Global Trajectory Optimization," IEEE Computer Society Conference on Computer Vision and Pattern Recognition, Jun. 17-22, 2006, New York, New York, USA, 7 pages.
Buckley, J. P., et al., "The sedentary office: an expert statement on the growing case for change towards better health and productivity," British Journal of Sports Medicine, vol. 49, Mar. 26, 2015, pp. 1357-1362.
Dalal, N., et al., "Histograms of Oriented Gradients for Human Detection," IEEE Computer Society Conference on Computer Vision and Pattern Recognition, Jun. 20-25, 2005, San Diego, California, USA, 8 pages.
Girod, L., et al., "Locating Tiny Sensors in Time and Space: A Case Study," Proceedings of the 2002 IEEE International Conference on Computer Design: VLSI in Computers and Processors, Sep. 16-18, 2002, Freiberg, Germany, pp. 214-219.
Hnat, T., et al., "Doorjamb: Unobtrusive Room-level Tracking of People in Homes using Doorway Sensors," Proceedings of the 2012 Sensys: The ACM Conference on Embedded Networked Sensor Systems, Nov. 6-9, 2012, Toronto, Canada, 14 pages.
HELLA Aglaia, "APS-90 Advanced People Counting Sensor Data Sheet," HELLA Aglaia Mobile Vision GmbH, Available online at: <<http://people-sensing.com/wp-content/uploads/2017/08/2017_11_Factsheet_APS-90E_EN_web.pdf>>, Nov. 2017, 1 page.
Jia, J., et al., "Image Stitching Using Structure Deformation," IEEE Transactions on Pattern Analysis and Machine Intelligence, vol. 30, No. 4, Apr. 2008, pp. 617-631.
Kalman, R. E., "A New Approach to Linear Filtering and Prediction Problems," Transactions of the ASME—Journal of Basic Engineering, vol. 82, Series D, Jan. 1960, 12 pages.
Kamthe, A., et al., "SCOPES: Smart Cameras Object Position Estimation System," Proceedings of the 2009 European Conference on Wireless Sensor Networks, In: Roedig, U., et al. (eds.), Lecture Notes in Computer Science, vol. 5432, Springer, 2009, pp. 279-295.
Kulkarn I, P., et al., "Senseye: A multi-tier camera sensor network," Proceedings of the 2005 13th Annual ACM International Conference on Multimedia, Nov. 6-12, 2005, Singapore, Singapore, pp. 229-238.
Mathew, M., et al., "Sparse, Quantized, Full Frame CNN for Low Power Embedded Devices," 2017 IEEE Conference on Computer Vision and Pattern Recognition Workshops (CVPRW), Jul. 21-26, 2017, Honolulu, Hawaii, USA, 9 pages.
Patwari, N., et al., "Relative Location Estimation in Wireless Sensor Networks," IEEE Transactions on Signal Processing, vol. 51, No. 8, Aug. 2003, pp. 2137-2148.
Satpathy, A., et al., "Human Detection by Quadratic Classification on Subspace of Extended Histogram of Gradients," IEEE Transactions on Image Processing, vol. 23, No. 1, Jan. 2014, 11 pages.
Szeliski, R., "Image Alignment and Stitching: A Tutorial," Foundations and Trends in Computer Graphics and Vision, vol. 2, No. 1, 2006, pp. 1-104.
Zeng, C., et al., "Robust Head-shoulder Detection by PCA-Based Multilevel HOG-LBP Detector for People Counting," 2010 International Conference on Pattern Recognition, Aug. 23-26, 2010, Istanbul, Turkey, 4 pages.
Zhu, Q., et al., "Fast Human Detection Using a Cascade of Histograms of Oriented Gradients," IEEE Computer Society Conference on Computer Vision and Pattern Recognition, Jun. 17-22, 2005, New York, New York, USA, 8 pages.
Zomet, A., et al., "Seamless Image Stitching by Minimizing False Edges," IEEE Transactions on Image Processing, vol. 15, No. 4, Apr. 2006, pp. 969-977.
Office Action for German Patent Application No. 10 2018 213 656.4, dated May 22, 2019, 9 pages.
Notice of Allowance for U.S. Appl. No. 15/681,941, dated Apr. 13, 2018, 8 pages.
Notice of Allowance for U.S. Appl. No. 15/681,941, dated Aug. 1, 2018, 8 pages.
Non-Final Office Action for U.S. Appl. No. 16/990,230, dated Apr. 1, 2021, 8 pages.
Minutes of the Oral Proceedings for European Patent Application No. 17705540.7, mailed Nov. 2, 2020, 4 pages.
Decision to Refuse for European Patent Application No. 17705540.7, dated Nov. 5, 2020, 25 pages.
Minutes of the Oral Proceedings for European Patent Application No. 17708904.2, mailed Nov. 2, 2020, 4 pages.
Decision to Refuse for European Patent Application No. 17708904.2, dated Nov. 5, 2020, 19 pages.
Office Action for Canadian Patent Application No. 3065545, dated Jan. 21, 2021, 4 pages.
Examination Report for European Patent Application No. 18738050.6, dated Dec. 4, 2020, 8 pages.
First Office Action for Chinese Patent Application No. 2018800390348, dated Aug. 18, 2021, 22 pages.
Examination Report for European Patent Application No. 19705900.9, dated Sep. 29, 2021, 7 pages.
Notice of Allowance for U.S. Appl. No. 16/990,230, dated Sep. 9, 2021, 7 pages.
Abdi, Hervé, "Metric Multidimensional Scaling (MDS): Analyzing Distance Matrices," Encyclopedia of Measurement and Statistics, 2007, Thousand Oaks, California, SAGE Publications, Inc., 13 pages.
Author Unknown, "Procrustes analysis," https://en.wikipedia.org/wiki/Procrustes_analysis, Jul. 16, 2016, Wikipedia, 5 pages.
Author Unknown, "Thread Commissioning," Revision 2.0, Jul. 13, 2015, Thread Group, Inc., www.threadgroup.org, 26 pages.
Author Unknown, "Thread Stack Fundamentals," Revision 2.0, Jul. 13, 2015, Thread Group, Inc., www.threadgroup.org, 21 pages.
Author Unknown, "The IES TM-30-15 Method," Lighting Passport, Available online at: <<https://www.lightingpassport.com/ies-tm30-15-method.html>>, Jan. 15, 2016, 6 pages.
Boots, Byron, et al., "A Spectral Learning Approach to Range-Only SLAM," Proceedings of the 30th International Conference on Machine Learning, vol. 28, 2013, Atlanta, Georgia, JMLR Workshop and Conference Proceedings, 8 pages.
Cree, "Cree® J Series™ 2835 LEDs," Product Family Data Sheet: CLJ-DS8 Rev 0D, Cree, Inc., Available online at: <<http://www.cree.com/led-components/media/documents/data-sheet-JSeries-2835.pdf>>, 2017, 30 pages.
Digeronimo, J., "EIC 2800 Search Report," Scientific and Technical Information Center, Mar. 14, 2018, 33 pages.

(56) References Cited

OTHER PUBLICATIONS

Figueiro, M. G., et al., "Light at Night and Measures of Alertness and Performance: Implications for Shift Workers," Biological Research for Nursing, vol. 18, Issue 1, Feb. 19, 2015, pp. 90-100.
Jacobson, J., "CoeLux: The $40,000 Artificial Skylight Everyone Will Want," CE Pro, Available online at: <<https://www.cepro.com/article/coelux_the_40000_fake_skylight_everyone_will_want>>, Mar. 11, 2016, 9 pages.
Kobourov, Stephen, G., "Force-Directed Drawing Algorithms," Handbook of Graph Drawing and Visualization, Chapter 12, 2013, CRC Press, pp. 383-408.
Lumileds, "DS146 LUXEON 3535L Color Line," Product Datasheet, Lumileds Holding B.V., Available online at: <<https://www.lumileds.com/uploads/565/DS146-pdf>>, 2018, 18 pages.
Rea, M. S., et al., "A model of phototransduction by the human circadian system," Brain Research Reviews, vol. 50, Issue 2, Dec. 15, 2005, pp. 213-228.
Rea, M. S., et al., "Circadian light," Journal of Circadian Rhythms, vol. 8, No. 2, Feb. 13, 2010, 11 pages.
Sahin, L., et al., "Alerting effects of short-wavelength (blue) and long-wavelength (red) lights in the afternoon," Physiology & Behavior, vols. 116-117, May 27, 2013, pp. 1-7.
Seoul Semiconductor, "STB0A12D—Mid-Power LED—3528 Series Product Data Sheet," Seoul Semiconductor Co., Ltd., Revision 1.0, Available online at: <<http://www.seoulsemicon.com/upload2/3528_STB0A12D_Spec_Rev1.0.pdf>>, Jul. 21, 2017, 19 pages.
Seoul Semiconductor, "STG0A2PD—Mid-Power LED—3528 Series Product Data Sheet," Seoul Semiconductor Co., Ltd., Revision 1.0, Available online at: <<http://www.seoulsemicon.com/upload2/3528_STG0A2PD_Spec_Rev1.0.pdf>>, Jul. 21, 2017, 19 pages.
International Preliminary Report on Patentability for International Patent Application No. PCT/US2017/016469, dated Aug. 23, 2018, 10 pages.
Non-Final Office Action for U.S. Appl. No. 15/192,308, dated Jul. 3, 2017, 11 pages.
Final Office Action for U.S. Appl. No. 15/192,308, dated Oct. 20, 2017, 12 pages.
Advisory Action and Interview Summary for U.S. Appl. No. 15/192,308, dated Jan. 25, 2018, 5 pages.
Non-Final Office Action for U.S. Appl. No. 15/192,308, dated Mar. 15, 2018, 10 pages.
Final Office Action for U.S. Appl. No. 15/192,308, dated Jul. 12, 2018, 11 pages.
Advisory Action for U.S. Appl. No. 15/192,308, dated Sep. 10, 2018, 3 pages.
Examiner's Answer for U.S. Appl. No. 15/192,308, dated Mar. 6, 2019, 5 pages.
Non-Final Office Action for U.S. Appl. No. 15/192,479, dated Jan. 6, 2017, 17 pages.
Non-Final Office Action for U.S. Appl. No. 15/192,479, dated Dec. 15, 2017, 11 pages.
Notice of Allowance for U.S. Appl. No. 15/192,479, dated May 9, 2018, 7 pages.
Non-Final Office Action for U.S. Appl. No. 15/192,035, dated May 31, 2017, 19 pages.
Final Office Action for U.S. Appl. No. 15/192,035, dated Sep. 14, 2017, 15 pages.
Advisory Action for U.S. Appl. No. 15/192,035, dated Dec. 1, 2017, 3 pages.
Non-Final Office Action for U.S. Appl. No. 15/192,035, dated Mar. 9, 2018, 16 pages.
Final Office Action for U.S. Appl. No. 15/192,035, dated Aug. 1, 2018, 20 pages.
Advisory Action for U.S. Appl. No. 15/192,035, dated Sep. 24, 2018, 3 pages.
Notice of Allowance for U.S. Appl. No. 15/192,035, dated Nov. 6, 2018, 8 pages.
Non-Final Office Action for U.S. Appl. No. 15/191,846, dated Mar. 22, 2017, 12 pages.
Notice of Allowance for U.S. Appl. No. 15/191,846, dated Jul. 13, 2017, 8 pages.
Non-Final Office Action for U.S. Appl. No. 15/191,753, dated Aug. 1, 2018, 11 pages.
Notice of Allowance for U.S. Appl. No. 15/191,753, dated Jan. 14, 2019, 23 pages.
Notice of Allowance for U.S. Appl. No. 15/621,695, dated Sep. 21, 2017, 8 pages.
Final Office Action for U.S. Appl. No. 15/849,986, dated Oct. 26, 2018, 7 pages.
Non-Final Office Action for U.S. Appl. No. 15/849,986, dated Apr. 19, 2018, 9 pages.
Notice of Allowance for U.S. Appl. No. 15/849,986, dated Nov. 26, 2018, 8 pages.
Corrected Notice of Allowability and Interview Summary for U.S. Appl. No. 15/849,986, dated Jan. 14, 2019, 6 pages.
International Search Report and Written Opinion for International Patent Application No. PCT/US2017/016448, dated Apr. 6, 2017, 16 pages.
International Preliminary Report on Patentability for International Patent Application No. PCT/US2017/016448, dated Aug. 23, 2018, 10 pages.
International Search Report and Written Opinion for International Patent Application No. PCT/US2017/016454, dated Apr. 6, 2017, 16 pages.
International Preliminary Report on Patentability for International Patent Application No. PCT/US2017/016454, dated Aug. 23, 2018, 10 pages.
International Search Report and Written Opinion for International Patent Application No. PCT/US2017/016469, dated Apr. 6, 2017, 16 pages.
International Search Report and Written Opinion for International Patent Application No. PCT/US2018/037048, dated Aug. 31, 2018, 15 pages.
Non-Final Office Action for U.S. Appl. No. 17/023,899, dated Mar. 17, 2022, 10 pages.
First Office Action for Chinese Patent Application No. 2019800122175, dated Dec. 29, 2021, 12 pages.
Non-Final Office Action for U.S. Appl. No. 16/932,959, dated Dec. 8, 2021, 14 pages.
Office Action for Canadian Patent Application No. 3089271, dated Oct. 8, 2021, 4 pages.
Examination Report for European Patent Application No. 18738050.6, dated Mar. 22, 2022, 6 pages.
Final Office Action for U.S. Appl. No. 16/932,959, dated Jun. 8, 2022, 16 pages.

* cited by examiner

```
1  {
2      "dynamic_lighting_instructions": [
3          {
4              "profile_id": 1001,
5              "destination_cct": 5000,
6              "destination_brightness": 70,
7              "transition_duration": 60
8          },
9          {
10             "profile_id": 1002,
11             "destination_cct": 5000,
12             "destination_brightness": 55,
13             "transition_duration": 45
14         },
15         {
16             "profile_id": 1003,
17             "destination_cct": 4500,
18             "destination_brighness": 4000,
19             "transition_duration": 30
20         }
21     ]
22 }
```

*Figure 5*

SYSTEMS AND METHODS FOR PROVIDING DYNAMIC LIGHTING

RELATED APPLICATIONS

This application claims the benefit of provisional patent application Ser. No. 62/926,862, filed Oct. 28, 2019, the disclosure of which is hereby incorporated herein by reference in its entirety.

FIELD OF THE DISCLOSURE

The present disclosure is related to dynamic lighting wherein one or more lighting devices provide lighting that changes over time to shape the environment of an indoor space.

BACKGROUND

Modern lighting devices continue to evolve, including significant functionality in addition to providing light for general illumination. Many modern lighting devices include communications circuitry and form a network with one or more other devices. Leveraging the functionality of modern lighting fixtures, it may be desirable to provide dynamic lighting in which one or more characteristics of light provided from a lighting device or a group of lighting devices changes over time to shape the environment of an indoor space.

SUMMARY

Systems and methods for providing dynamic lighting are provided. In an exemplary aspect, one or more characteristics of light provided from a lighting device or a group of lighting devices changes over time to shape the environment of an indoor space according to dynamic lighting instructions. Dynamic lighting may improve the health or wellbeing of individuals in an indoor space, for example, by simulating an outdoor environment to reduce stress, by providing circadian entrainment to improve sleep and wakefulness, or the like. Other aspects of the present disclosure enable lighting devices to provide light that is synchronized with one or more other devices and does not significantly drift over time so that the lighting devices can provide seamless dynamic lighting experiences that shape the environment of an indoor space.

In one embodiment, a lighting device includes a light source, communications circuitry, processing circuitry, and a memory. The processing circuitry is coupled to the light source and the communications circuitry. The memory is coupled to the processing circuitry and stores instructions, which, when executed by the processing circuitry cause the lighting device to receive dynamic lighting instructions via the communications circuitry. The dynamic lighting instructions include transition information. In response to receiving the dynamic lighting instructions, the lighting device determines a light output function for changing a light output characteristic of the light source based on the transition information. The lighting device then adjusts a light output characteristic variable for controlling the light source over time such that the light output characteristic transitions from its current state based on the light output function. By operating the lighting device as described above, dynamic lighting can be synchronized across lighting devices with minimal communication overhead and seamless transitions in light output.

In another embodiment, a method for providing dynamic lighting includes receiving dynamic lighting instructions at a lighting device. The dynamic lighting instructions including transition information. In response to receiving the dynamic lighting instructions at the lighting device, the method further includes determining a light output function for changing a light output characteristic of a light source based on the transition information. The method further includes adjusting, over time, a light output characteristic variable for controlling the light source such that the light output characteristic transitions from its current state based on the light output function.

In another embodiment, an intelligent lighting coordinator includes communications circuitry, processing circuitry, and a memory coupled to the processing circuitry. The processing circuitry is coupled to the communications circuitry. The memory stores instructions, which, when executed by the processing circuitry cause the intelligent lighting coordinator to receive a lighting control input via the communications circuitry and determine a first lighting control profile from the lighting control input. The intelligent lighting coordinator further determines dynamic lighting instructions for changing a light output characteristic of a light source based on the first lighting control profile and transmits the dynamic lighting instructions via the communications circuitry.

In another embodiment, an intelligent lighting system includes an intelligent lighting coordinator and a plurality of lighting devices. The intelligent lighting coordinator includes coordinator processing circuitry, and a coordinator memory. The coordinator memory stores instructions, which, when executed by the coordinator processing circuitry cause the intelligent lighting coordinator to receive a lighting control input and determine a first lighting control profile from the lighting control input. The intelligent lighting coordinator further transmits dynamic lighting instructions based on the first lighting control profile. Each one of the plurality of lighting devices includes a light source, lighting device processing circuitry, and a lighting device memory. The lighting device memory stores instructions, which, when executed by the lighting device processing circuitry cause the one of the plurality of lighting devices to in response to receiving the dynamic lighting instructions, determine a light output function for changing a light output characteristic of the light source using the dynamic lighting instructions and adjust a light output characteristic variable for controlling the light source over time such that the light output characteristic transitions from its current state based on the light output function.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the disclosure, and together with the description serve to explain the principles of the disclosure.

FIG. 5 illustrates dynamic lighting instructions according to one embodiment of the present disclosure.

DETAILED DESCRIPTION

Figure 1:
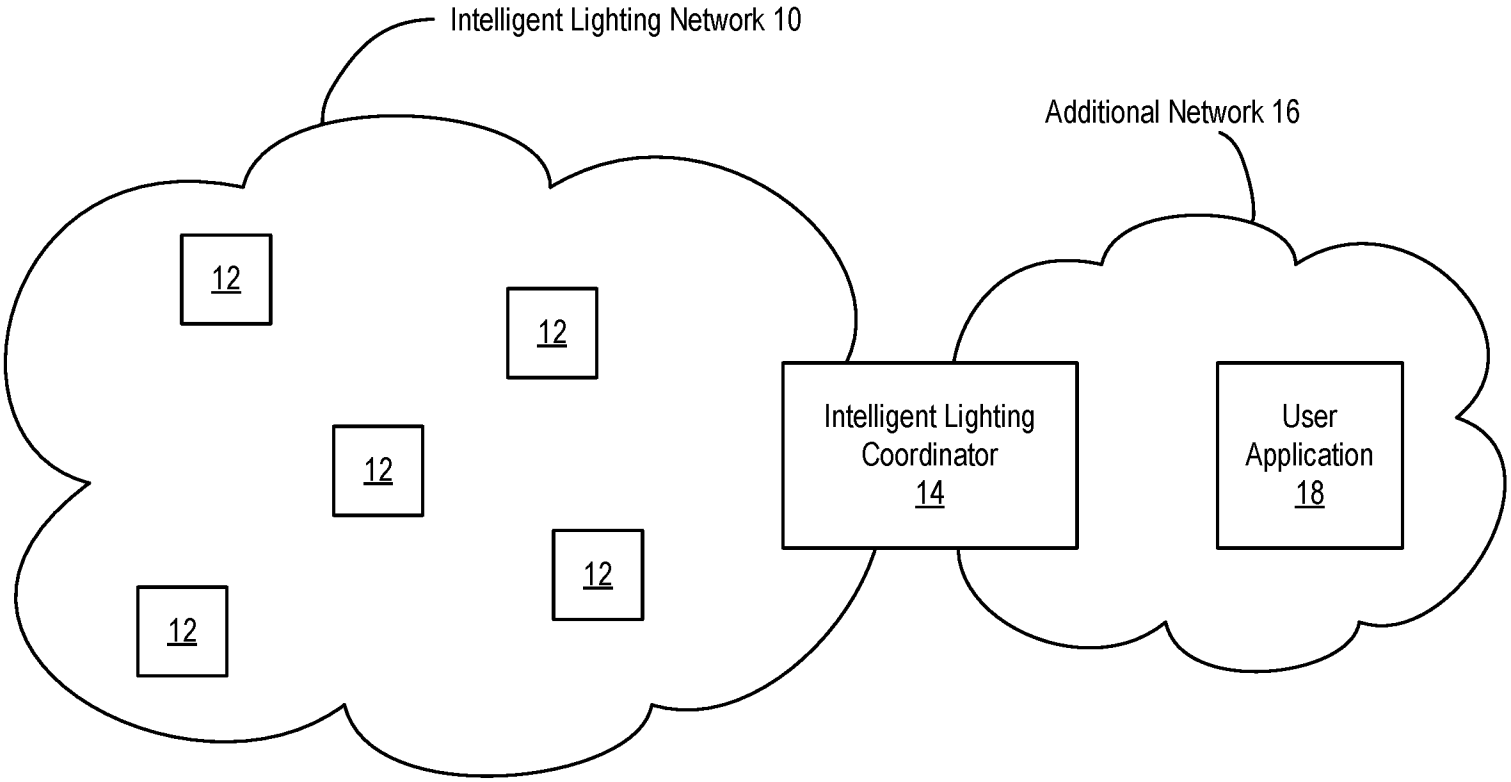
FIG. 1 illustrates an intelligent lighting network according to one embodiment of the present disclosure.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

It will be understood that when an element such as a layer, region, or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. Likewise, it will be understood that when an element such as a layer, region, or substrate is referred to as being "over" or extending "over" another element, it can be directly over or extend directly over the other element or intervening elements may also be present. In contrast, when an element is referred to as being "directly over" or extending "directly over" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer, or region to another element, layer, or region as illustrated in the Figures. It will be understood that these terms and those discussed above are intended to encompass different orientations of the device in addition to the orientation depicted in the Figures.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

As discussed above, it may be desirable to provide dynamic lighting in which one or more characteristics of light provided from a lighting device or a group of lighting devices changes over time to shape the environment of an indoor space. Dynamic lighting may improve the health or wellbeing of individuals in an indoor space, for example, by simulating an outdoor environment to reduce stress, by providing circadian entrainment to improve sleep and wakefulness, or the like. Conventionally, synchronization of the light output of multiple lighting devices has required significant overhead in the form of communications between lighting devices and one or more coordinator devices (i.e., lots of messages sent at very short intervals). Often, lighting devices form part of a low bandwidth mesh network in which available data throughput is relatively low. For this reason, conventional methods for synchronization of lighting devices may not be capable of providing a seamless dynamic lighting experience due to the fact that they will flood such a low bandwidth network and thus interrupt the synchronization of the light output of lighting devices. Further, conventional methods for synchronizing the light output of lighting devices are not tolerant to dropped messages, since the lighting devices rely on messages from the one or more coordinator devices to change any aspect of the light output provided therefrom. Dropped messages may result in no changes in the light output from the lighting devices, and when a message finally does arrive at a lighting device may result in an abrupt change in light output that is disruptive to individuals in the space.

Alternatively, dynamic lighting has required a real time clock at each lighting device for accurate timekeeping and thus synchronization. Integrating a real time clock into a lighting device adds overhead in terms of both cost and complexity to the lighting device. Accordingly, it is often not practical to do so.

Aspects of the present disclosure enable lighting devices to provide light that is synchronized with one or more other devices and does not significantly drift over time so that the lighting devices can provide seamless dynamic lighting experiences that shape the environment of an indoor space.

FIG. 1 shows a high-level overview of an intelligent lighting network 10 according to one embodiment of the present disclosure. The intelligent lighting network 10 includes one or more lighting devices 12 and an intelligent lighting coordinator 14. The intelligent lighting network 10 may be a mesh network such as one based on the IEEE 802.15.4 standard. The intelligent lighting coordinator 14 may also be part of an additional network 16 such as a TCP/IP network (e.g., via ethernet, WiFi, or any other suitable connection mechanism). Accordingly, the intelligent lighting coordinator 14 may provide gateway functionality to bridge communication between the intelligent lighting network 10 and the additional network 16. A user application 18 may connect to the intelligent lighting coordinator 14 via the additional network 16 in order to determine information about the one or more lighting devices 12 and/or control one or more aspects of the functionality of the one or more lighting devices 12. The user application 18 may be a software application running on a computing device such as a smartphone, a tablet, a computer, or the like.

Figure 2:
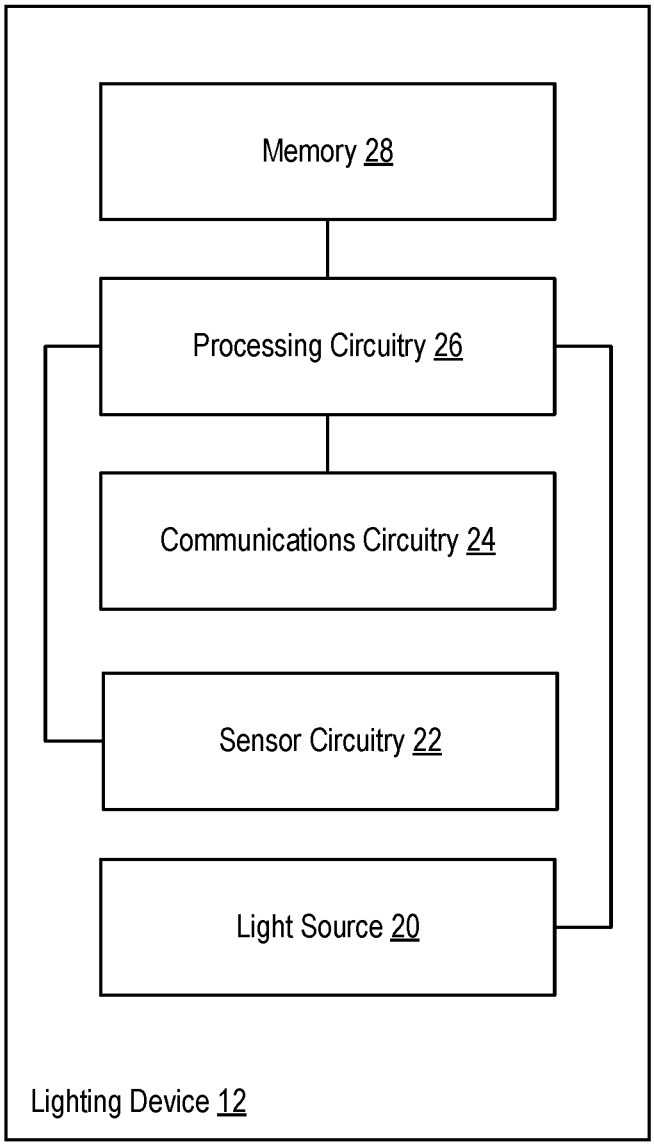
FIG. 2 illustrates a lighting device according to one embodiment of the present disclosure.

FIG. 2 illustrates details of a lighting device 12 in the intelligent lighting network 10 according to one embodiment of the present disclosure. The lighting device 12 includes a light source 20, sensor circuitry 22 including one or more sensors, communications circuitry 24, processing circuitry 26 coupled to the light source 20, the sensor circuitry 22, and the communications circuitry 24, and a memory 28 coupled to the processing circuitry 26. The light source 20 may include any suitable type of light source for providing light for general illumination. For example, the light source 20 may include a number of light emitting diodes (LEDs).

In some embodiments, the processing circuitry 26 provides control signals for controlling the light source 20 according to one or more light output characteristics, while circuitry for providing signals suitable to drive the light source 20 in accordance with the control signals is integrated into the light source 20 itself. In other embodiments, drive signals may be provided directly by the processing circuitry 26 or may be provided by external circuitry such as driver circuitry, which is not shown. The sensor circuitry 22 may include any number of sensors such as an ambient light sensor, an occupancy sensor, one or more image sensors, a temperature sensor, or the like, and may provide sensor data from the one or more sensors to the processing circuitry 26 in order to enable certain functionality of the lighting device 12 discussed below. The communications circuitry 24 enables communication with other devices such as one or more other lighting devices 12 and the intelligent lighting coordinator 14. The memory 28 stores instructions, which, when executed by the processing circuitry 26 cause the lighting device 12 to perform one or more functions, such as provide dynamic lighting as discussed in detail below.

In some embodiments, the lighting device 12 includes multiple light sources 20, such as a direct light panel and an indirect light panel. In some embodiments, further light sources 20 may be included, such as a sky-emulating light source (e.g., where another light source may be a sun-emulating light source). In an exemplary aspect, the processing circuitry 26 provides control signals for controlling each of the light sources 20 independently according to one or more light output characteristics.

Figure 3:
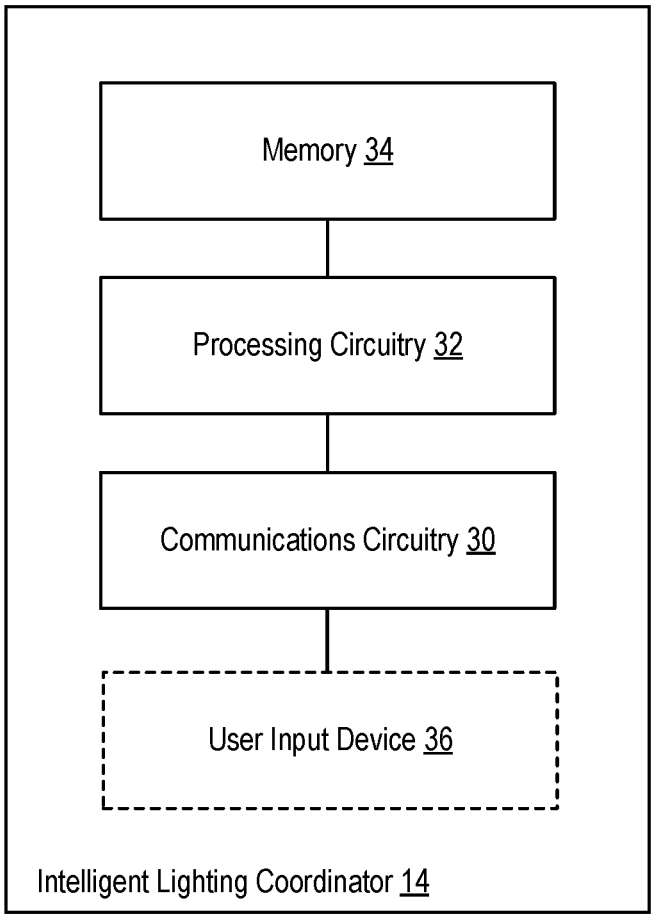
FIG. 3 illustrates an intelligent lighting coordinator according to one embodiment of the present disclosure.

FIG. 3 illustrates details of the intelligent lighting coordinator 14 according to one embodiment of the present disclosure. The intelligent lighting coordinator 14 includes communications circuitry 30, processing circuitry 32, a memory 34, and optionally a user input device 36. The communications circuitry 30 enables communication with other devices such as the one or more lighting devices 12 and the user application 18. Accordingly, the communications circuitry 30 may have multiple communications interfaces such as a first type of communications interface to communicate with the one or more lighting fixtures 12 and a second type of communications interface to communicate with the user application 18 (e.g., via the user input device 36, which may be a touch input display). The memory 34 stores instructions, which, when executed by the processing circuitry 32 cause the intelligent lighting coordinator 14 to perform one or more functions, such as coordinating dynamic lighting as discussed in detail below.

Figure 4:
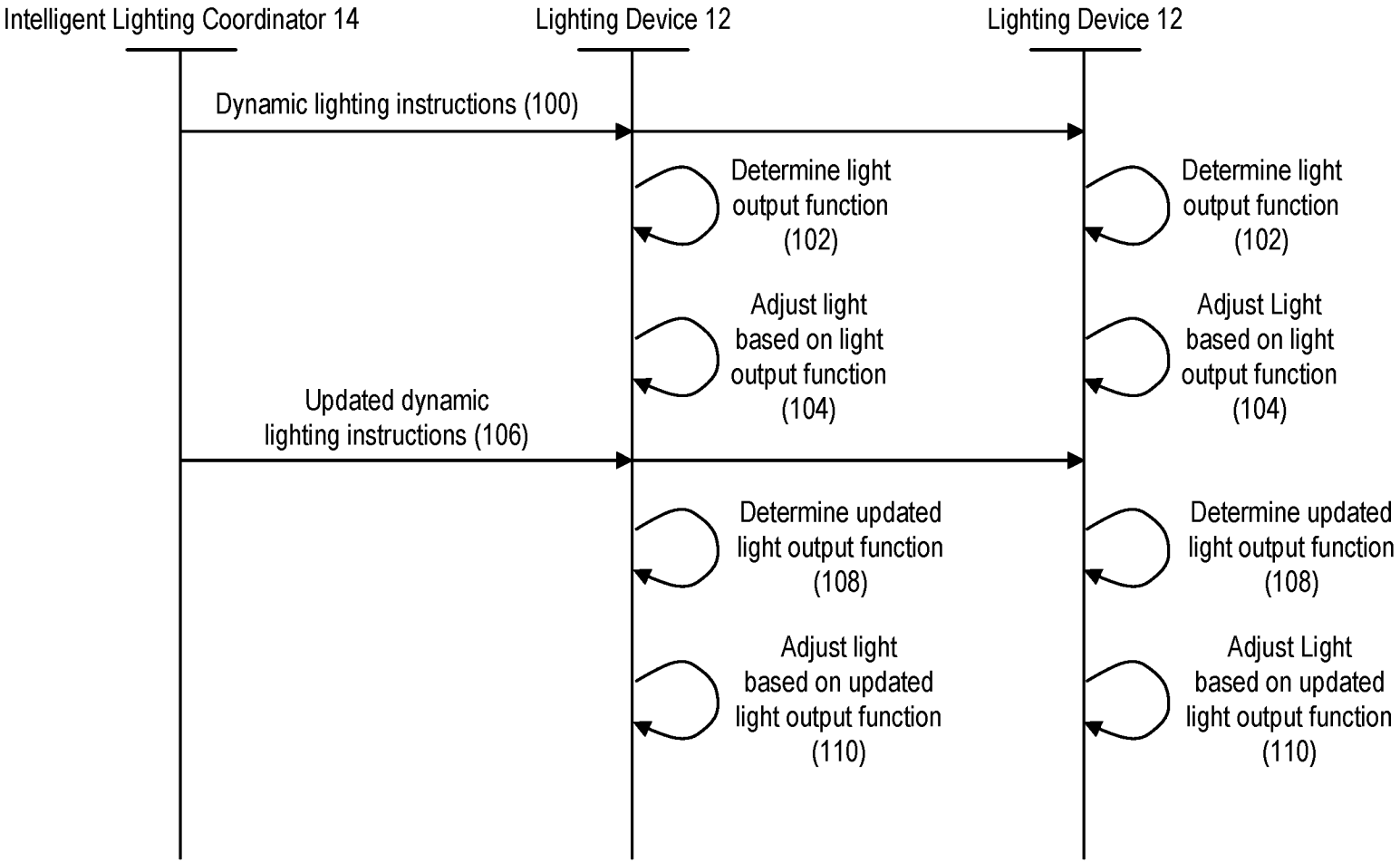
FIG. 4 illustrates interaction between an intelligent lighting coordinator and a lighting device to provide dynamic lighting according to one embodiment of the present disclosure.

FIG. 4 is a call flow diagram illustrating a method for providing dynamic lighting according to one embodiment of the present disclosure. As described below, the intelligent lighting coordinator 14 coordinates dynamic lighting from the one or more lighting devices 12 in such a way that communications bandwidth relating to the dynamic lighting is minimized. The lighting devices 12 operate semi-autonomously to provide dynamic lighting with minimal updates from the intelligent lighting coordinator 14. First, dynamic lighting instructions are provided from the intelligent lighting coordinator 14 to one or more lighting devices 12 (block 100). The dynamic lighting instructions include transition information for one or more light output characteristics of the light provided by each one of the lighting devices 12. In some examples, the transition information includes a destination state of the one or more light output characteristics and a transition duration, where the transition duration specifies a duration of time over which a transition from a current state of the one or more light output characteristics to the destination state should occur. In other examples, the transition information includes the destination state and a transition end time (e.g., expressed as a relative time, an absolute time, a number of cycles of known duration, etc.). In still other examples, the transition information includes a light output function and may additionally include one or more of a transition duration, a destination state, or a transition end time.

Exemplary dynamic lighting instructions are shown in FIG. 5. As shown, the dynamic lighting instructions include a destination state for a correlated color temperature (CCT) in Kelvin (K), a destination state for a brightness in percentage, and a transition duration in minutes for each one of a first profile identifier, a second profile identifier, and a third profile identifier. The destination state indicates a desired value for the light output parameter (CCT and brightness in the present example; other examples may additionally or alternatively include sky emulation color, sun emulation position, modulation for communications, or the like). The transition duration indicates the amount of time over which a transition from a current state of the light output parameter to the destination state should occur. The profile identifier is used to specify which lighting device 12 or lighting devices 12 the destination states associated with the profile identifier are intended for. Each lighting device 12 may be associated with a profile identifier and thus may use only those destination states provided with the matching profile identifier in the dynamic lighting instructions. In one example, if a lighting device 12 is associated with the first profile identifier (1001), a current state of the CCT of the light source 20 of the lighting device 12 is 3000 K, and a current state of the brightness of the light source 20 of the lighting device 12 is 40%, the dynamic lighting instructions indicate that the CCT of the light source 20 should transition from 3000 K to 5000 K and the brightness of the light source 20 should transition from 40% to 70% over the course of 60 minutes.

In some embodiments, the different profile identifiers are used to differentiate lighting devices 12 at different spatial locations within a space. For example, lighting devices 12 associated with the first profile identifier may be located at a first end of a space, lighting devices 12 associated with the second profile identifier may be located at a middle of the space, and lighting devices 12 associated with the third profile identifier may be located at a second end of the space opposite the first end. The destination states associated with each profile identifier may be configured to provide dynamic lighting that is coordinated across the space (e.g., light appears to move from the first end of the space to the second end of the space) over time. In embodiments discussed below, the dynamic lighting instructions are generated automatically based on knowledge of a spatial relationship between lighting devices 12 to provide such an effect. In some embodiments, different profile identifiers may additionally or alternatively be used to differentiate between light sources 20 within a same lighting device 12 (e.g., to differentiate an indirect/uplight from a direct/downlight).

Notably, the dynamic lighting instructions shown in FIG. 5 are merely exemplary and provided for purposes of discussion. The dynamic lighting instructions may include more or less information according to various embodiments of the present disclosure. For example, the dynamic lighting instructions may include a destination state for directionality of light provided from a lighting device 12 for lighting devices 12 that are capable of adjusting a directionality of light provided therefrom. Exemplary lighting devices 12 capable of providing light having adjustable directionality are discussed at length in U.S. Pat. No. 10,781,984 titled "Skylight Fixture," the contents of which are hereby incorporated by reference in their entirety.

In response to receiving the dynamic lighting instructions, each lighting device 12 determines a light output function for changing from the current state of each light output characteristic based on the transition information (block 102). Details regarding determination of the light output function are discussed below. Each lighting device 12 then adjusts one or more light output characteristic variables over time based on the light output function such that the light output characteristics transition from the current state based on the light output function (block 104).

The light output characteristic variables are used, in a first mode (e.g., normal mode) of the lighting devices 12, to adjust the one or more light output characteristics of each light source 20. In some modes of the lighting devices 12 (e.g., based on occupancy events, due to an override instruction, in an emergency, etc.), the light output characteristic variables are not used to adjust the light output characteristics. However, in such modes, the light output characteristic variables may continue to be calculated based on the light output functions and are stored in the memory for when the first mode resumes.

Notably, each one of the lighting devices 12 continues to adjust the light output characteristic variables based on the determined light output function after the dynamic lighting instructions are received such that the lighting devices 12 operate semi-autonomously to transition between the current state and the destination state. However, as discussed above, the lighting devices 12 may not have access to a real time clock and thus may approximate a clock by counting processor clock cycles. Accordingly, the lighting devices 12 may experience timing drift such that they become unsynchronized with one or more other lighting devices 12.

To keep the light output from the lighting devices 12 synchronized, at some update interval the intelligent lighting coordinator 14 sends updated dynamic lighting instructions to the lighting devices 12 (block 106). The updated dynamic lighting instructions include updated transition information, such as an updated destination state (which may or may not change from the original dynamic lighting instructions) and an updated transition duration (or transition end time). The updated transition duration may be equal to the last transition duration sent minus the amount of time that has passed since the last dynamic lighting instructions were sent. For example, in a first set of updated dynamic lighting instructions sent five minutes after the original dynamic lighting instructions, the transition duration for the first profile identifier may be 55 minutes (60 minutes-5 minutes). In other examples, synchronization may be provided in another manner, such as through periodic transmission of a clock synchronization signal.

In response to receiving the updated dynamic lighting instructions, each lighting device 12 determines an updated light output function for each light output parameter based on the updated transition information (block 108). Each lighting device 12 then adjusts the one or more light output characteristic variables over time based on the updated light output function such that the light output characteristics transition from the current state based on the updated light output function (e.g., to the updated destination state over the updated transition duration) (block 110).

By updating the light output function (e.g., slope) each time updated dynamic lighting instructions are received and adjusting light output characteristics based on the updated light output function (e.g., an updated calculated slope between the current state and the destination state), the lighting devices 12 are able to provide transitions between different light output characteristics with minimal updates from the intelligent lighting coordinator 14 while simultaneously avoiding abrupt changes in light output characteristics. If a lighting device 12 experiences some timing drift between updated dynamic lighting instructions, the updated light output function may be different from the light output function determined in response to the previously received dynamic lighting instructions. The lighting device 12 will not attempt to adjust the light output characteristics back to the previously determined function, which may result in an abrupt change in the light output characteristics that would be disruptive to individuals in the space. Instead, the updated light output function is used to adjust the light output characteristics as discussed above.

In some embodiments, the dynamic lighting instructions may be used to adjust other settings for operating the lighting device 12 in addition to adjusting the light output characteristics (block 104, block 110). For example, operation of the sensor circuitry 22 may be adjusted (e.g., to activate, deactivate, adjust sensitivity, etc.), or other settings used for controlling the light sources (e.g., occupancy level, daylight settings, scheduled operations, etc.) may be adjusted.

Figure 6:
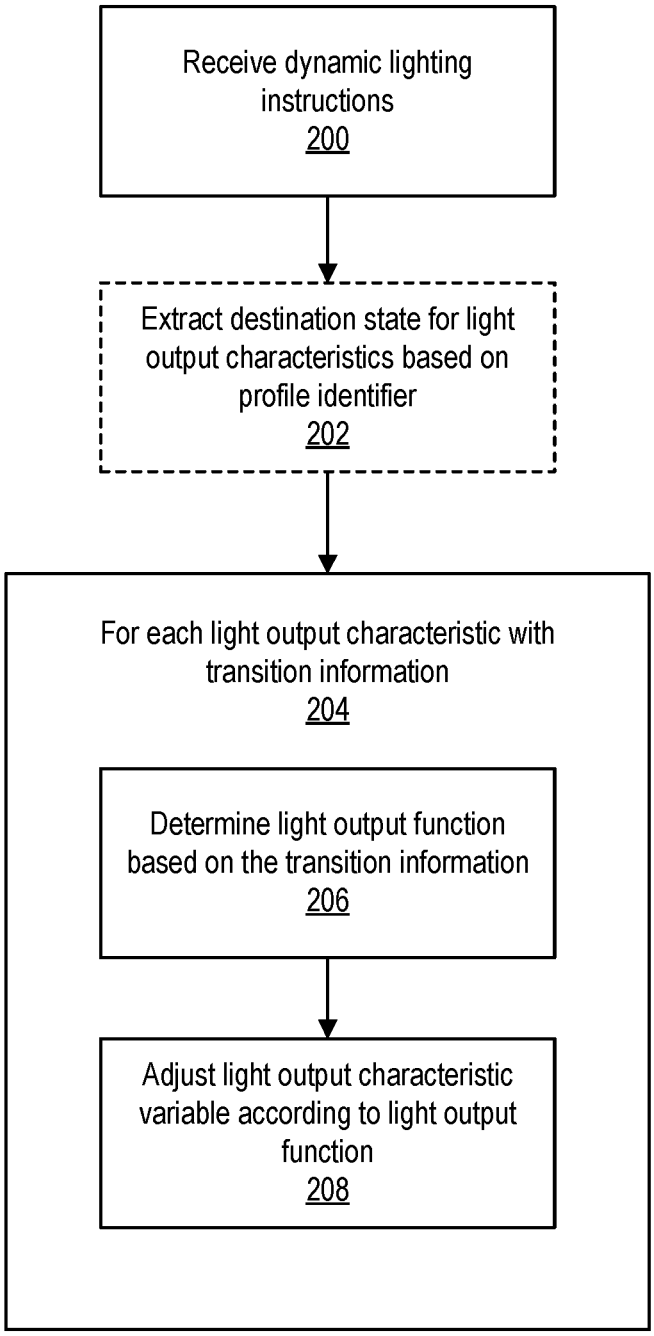
FIG. 6 illustrates a method for providing dynamic lighting from a lighting device according to one embodiment of the present disclosure.

FIG. 6 is a flow diagram illustrating a method for providing dynamic lighting from the lighting device 12 according to one embodiment of the present disclosure. First, dynamic lighting instructions are received at the lighting device 12 (block 200). The dynamic lighting instructions may be similar to those discussed above with respect to FIG. 5. Accordingly, the dynamic lighting instructions may include transition information (e.g., a destination state, a transition duration, a transition end time, a light output function) for one or more light output characteristics of the light source 20 of the lighting device 12. For example, the dynamic lighting instructions may include a destination state or light output function for CCT and brightness.

As discussed above, the dynamic lighting instructions may include a destination state or light output function for one or more light output characteristics for the lighting devices 12 having different profile identifiers. Accordingly, a destination state for one or more light output characteristics is optionally extracted from the dynamic lighting instructions based on a profile identifier associated with the lighting device 12 (block 202). For example, if the lighting device 12 is associated with the first profile identifier (1001), the destination states for CCT and brightness associated with the first profile identifier may be extracted from the dynamic lighting instructions for calculation of the light output function discussed below.

For each one of the light output characteristics having transition information (block 204), a light output function is calculated based on the transition information (e.g., a slope between the current state of the light output characteristic and the destination state) for the light output characteristic (block 206). For example, if the light output characteristics include CCT and brightness, a slope between the current CCT and the destination CCT will be calculated and a slope between the current brightness and the destination brightness will be calculated. The one or more light output characteristics are then adjusted according to the slope calculated for each light output characteristic (block 208) such that the one or more light output characteristic variables (e.g., and the light output characteristics themselves) transition from the current state to the destination state over the transition duration. It should be understood that the light output function is not limited to a slope, but may also be any appropriate function for adjusting the light output characteristics over time, such as a geometric function, a circadian function, and so on. The memory 28 of the lighting device 12 may store instructions, which, when executed by the processing circuitry 26 cause the lighting device 12 to provide the functionality discussed above.

Figure 7:
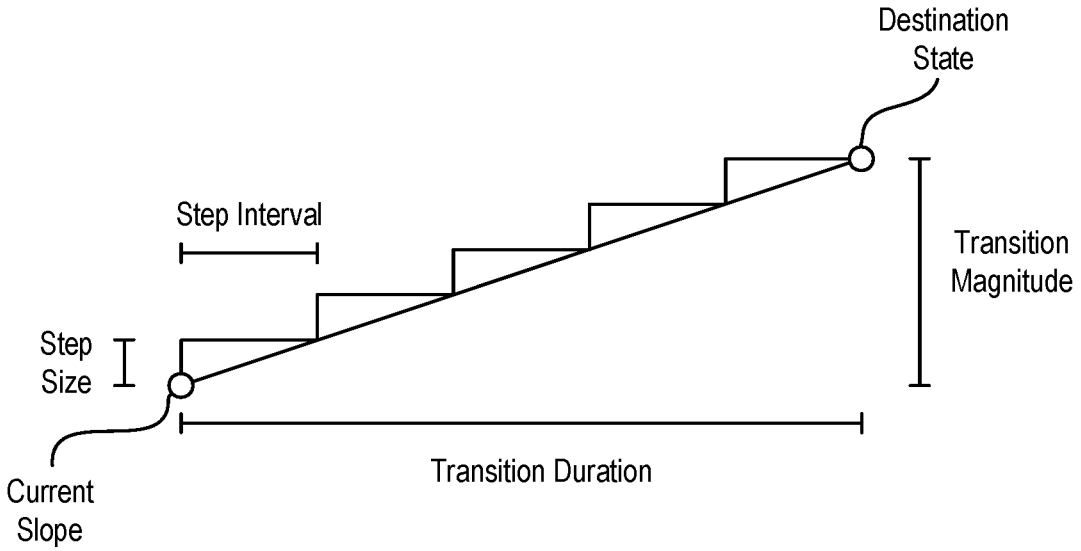
FIG. 7 illustrates details of calculating a slope between a current state of a light output characteristic and a destination state according to one embodiment of the present disclosure.

FIG. 7 illustrates an example of determining a light output function by calculating a slope between a current state of a light output characteristic and a destination state of the light output characteristic. To calculate the slope, a transition magnitude is calculated as the difference between the current state and the destination state. Using the dynamic lighting instructions shown in FIG. 5 as an example and referring back to the example wherein the lighting device 12 is associated with the first profile identifier (1001), and a current state of the CCT of the light source 20 of the lighting device 12 is 3000 K, the transition magnitude is 2000 K (5000 K destination state as specified in the dynamic lighting instructions−3000 K current state=2000 K). The transition duration is 60 minutes as specified in the dynamic lighting instructions. The slope is thus the transition magnitude over the transition duration, which in the present example is 2000 K/60 min or 33.33 K/min.

The light source 20 of the lighting device 12 may be limited in the resolution available for adjusting a given light output characteristic, as determined by a minimum step size representing the minimum amount by which a light output characteristic can be changed. This is dictated by the light source 20 itself as well as the circuitry that drives the light source 20. Due to the limits on the adjustability of the light output characteristics of the light source 20, a number of steps between the current state and the destination state may be calculated by dividing the transition magnitude by the step size. In the example shown, the step size is 400 K, thereby providing 5 steps between the current state and the destination state (2000 K/400 K=5). A step interval is then calculated by dividing the transition duration by the number of steps (60 min/5=12 min). The step interval is the interval between which the light output characteristic (in the present example CCT) should be changed by the minimum step size in the direction of the destination state. With the step interval calculated, the lighting device 12 now knows that it should change the CCT by the minimum step size (400 K) every 12 minutes to arrive at the destination state of 5000 K in 60 minutes.

Figure 8:
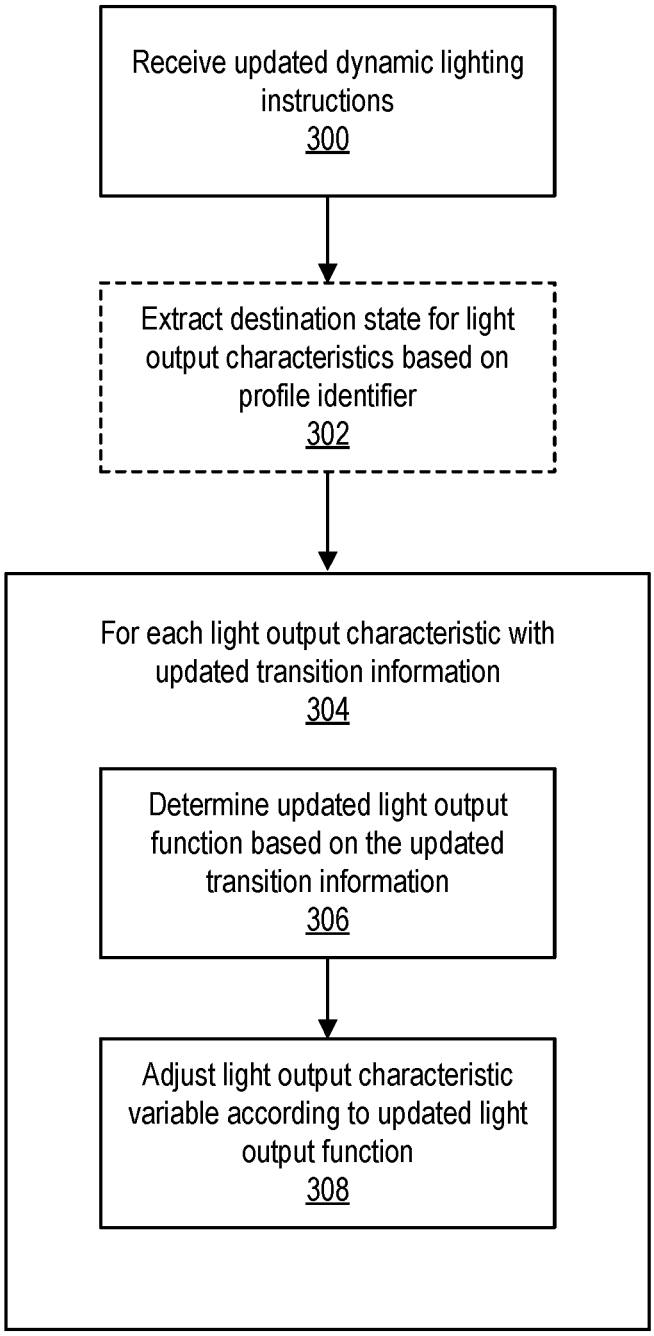
FIG. 8 illustrates a method for providing dynamic lighting from a lighting device according to one embodiment of the present disclosure.

FIG. 8 is a flow diagram illustrating further details of the method for providing dynamic lighting from the lighting device 12 shown in FIG. 6 according to one embodiment of the present disclosure. First, updated dynamic lighting instructions are received at the lighting device 12 (block 300). The updated dynamic lighting instructions include updated transition information (e.g., an updated destination state and/or updated light output function) for one or more light output characteristics of the light source 20 of the lighting device 12 and an updated transition duration (or updated transition end time). A destination state (and/or other transition information for one or more light output characteristics is optionally extracted from the dynamic lighting instructions based on a profile identifier associated with the lighting device 12 (block 302).

For each one of the light output characteristics having updated transition information (block 304), an updated light output function is determined (e.g., an updated slope is calculated between the current state and the updated destination state) for the light output characteristic (block 306). The one or more light output characteristic variables are then adjusted according to the slope calculated for each light output characteristic (block 308) such that the one or more light output characteristics transition from the current state to the destination state over the transition duration. The memory 28 of the lighting device 12 may store instructions, which, when executed by the processing circuitry 26 cause the lighting device 12 to provide the functionality discussed above.

Figure 9:
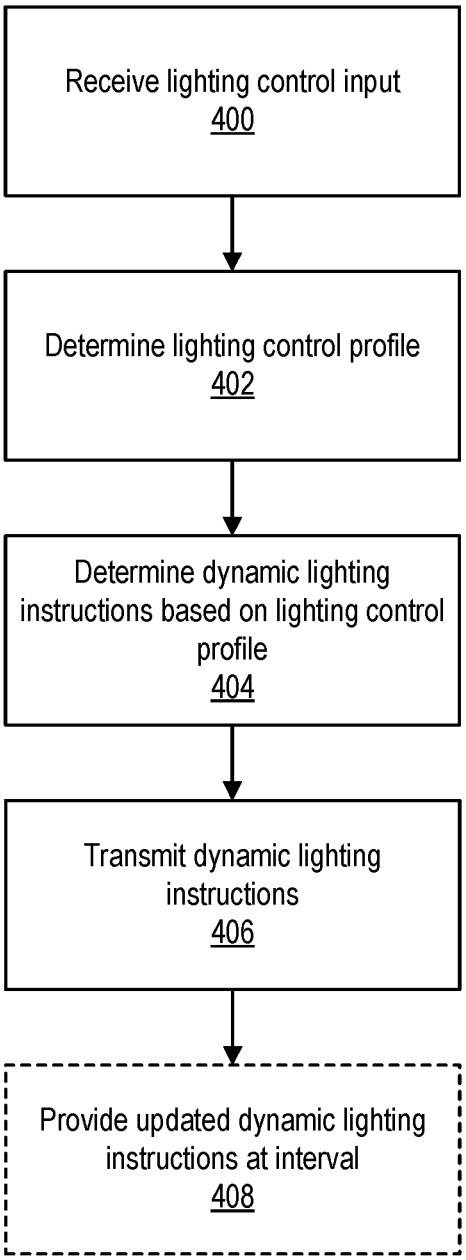
FIG. 9 illustrates a method for coordinating dynamic lighting from an intelligent lighting coordinator according to one embodiment of the present disclosure.

FIG. 9 is a flow diagram illustrating a method for providing dynamic lighting instructions from the intelligent lighting coordinator 14 according to one embodiment of the present disclosure. First, a lighting control input is received via the communications circuitry 30 (e.g., from the user input device 36) (block 400). A lighting control profile is determined from the lighting control input (block 402). The lighting control profile is used for dynamically adjusting one or more lighting characteristics associated with one or a plurality of light sources 20. The lighting control input may therefore correspond to user creation or adjustment of one or more lighting control profiles (e.g., adjusting start time, end time, duration, destination state, etc. of a lighting transition).

Dynamic lighting instructions are determined by the intelligent lighting coordinator 14 based on the lighting control profile (block 404). The dynamic lighting instructions may be similar to those discussed with respect to FIG. 5 above. Determining the dynamic lighting instructions may involve translating graphical interface-based inputs into lighting characteristics to be adjusted, as well as the manner of their adjustment such that communications bandwidth relating to the dynamic lighting is minimized. The intelligent lighting coordinator 14 transmits the dynamic lighting instructions to one or more lighting devices 12 (block 406).

Optionally, at some interval, updated dynamic lighting instructions may be provided (block 408). The interval may be determined by a timing drift associated with the lighting devices 12. For example, a measurable timing drift of the lighting devices 12 may result in noticeable differences between adjacent lighting devices 12 over some period of time if the updated dynamic lighting instructions are not provided. This period of time may be used to determine the interval used to send updated dynamic lighting instructions. The memory 34 of the intelligent lighting coordinator 14 may store instructions, which, when executed by the processing circuitry 32 cause the intelligent lighting coordinator 14 to provide the functionality discussed above.

By only sending updated dynamic lighting instructions at certain intervals and operating the lighting devices 12 in a semi-autonomous manner such that a slope between a current state and a destination state is calculated for each set of dynamic lighting instructions received as discussed above, the lighting devices 12 can remain synchronized when providing dynamic lighting with minimal overhead in terms of communication between the lighting devices 12 and the intelligent lighting coordinator 14. Further, abrupt changes in the light output of the lighting devices 12 are avoided to provide a pleasant and seamless dynamic lighting experience.

In an exemplary aspect, the lighting devices 12 operate in multiple modes. In a first mode, which may be considered a normal mode, a lighting device 12 operates as described above, with dynamic lighting provided according to dynamic lighting instructions received from the intelligent lighting coordinator 14. The lighting device 12 may operate in a second mode in response to a triggering event (e.g., received from an occupancy sensor, a wall controller, a scene controller, an emergency system, etc.) in which the lighting device may not provide all functions of the normal mode. For example, the second mode may be an override mode in which one or more of the light output functions derived from the dynamic lighting functions are overridden. While the light output functions are overridden, the adjustment of the light output characteristic variables may terminate, may be paused, or may continue such that the dynamic lighting resumes when the lighting device 12 exits the override mode.

In an example, the first mode may correspond to an occupancy state determined from occupancy sensor data (e.g., from an occupancy sensor in the lighting device 12 or received from another device). The second mode may correspond to an unoccupied state such that the light source is off, outputs at a low brightness, or otherwise is not adjusted in accordance with the dynamic functions described above. However, some of the light output characteristics may continue to be dynamically adjusted, such as the CCT. An example is further illustrated below.

Figure 10:
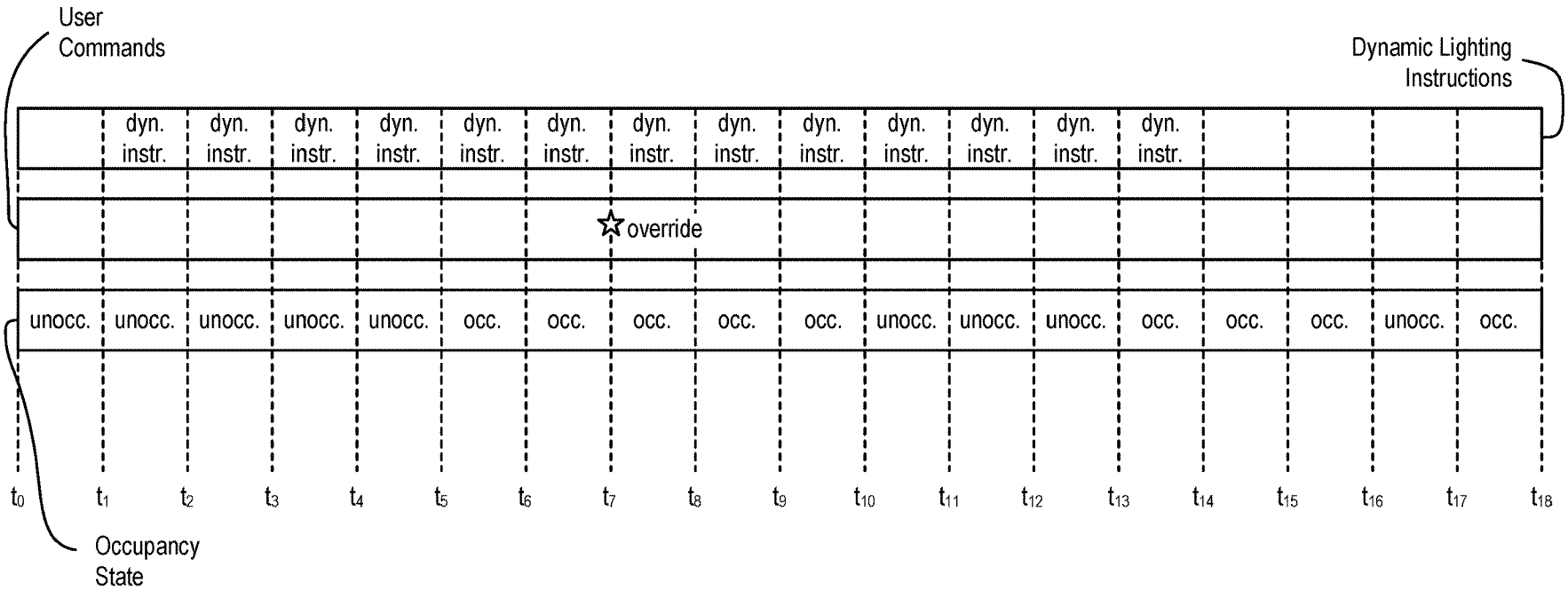
FIG. 10 illustrates a dynamic lighting program according to one embodiment of the present disclosure.

FIG. 10 is a diagram illustrating a dynamic lighting program according to one embodiment of the present disclosure. A first line illustrates dynamic lighting instructions provided to the lighting device 12. A second line illustrates user commands (e.g., from the user application 18, the user input device 36, a wall controller, etc.) provided to the lighting device 12. A third line illustrates an occupancy state, which may be detected by the sensor circuitry 22 of the lighting device 12. As discussed below, the light output from the lighting device 12 is influenced by the dynamic lighting instructions, the user commands, and the occupancy state. The present example is discussed as it relates to a CCT and brightness of light provided from the light source 20 of the lighting device 12. However, as discussed above, additional light output characteristics may be adjusted in a similar manner.

Between time $t_0$ and $t_1$, the occupancy state is unoccupied and no user commands or dynamic lighting instructions have been provided to the lighting device 12. Accordingly, a CCT and brightness of light from the light source 20 are both provided at an unoccupied level (e.g., according to a second mode), which is a predetermined level for the CCT and brightness. At time $t_1$, dynamic lighting instructions are provided to the lighting device 12. In response to the dynamic lighting instructions and as discussed above, the lighting device 12 determines a light output function (e.g., calculates a slope between the current state and a desired state). In the present example, a slope between a current state of the CCT and the desired state of the CCT and a slope between a current state of the brightness and the desired state of the brightness is calculated. However, since the occupancy state is unoccupied, only the CCT is adjusted according to the slope calculated for the CCT while the brightness of the lighting device 12 is kept at the unoccupied level to save power.

Notably, this is merely one example of how the lighting device 12 can behave, and in some embodiments both the CCT and brightness of the lighting device 12 may be adjusted according to the slope calculated for each one of these characteristics even when the occupancy state is unoccupied (e.g., the light output characteristic variables may be stored but not output). Table 1 illustrates various ways that a lighting device 12 can respond to an occupancy state and other commands based on one embodiment of the present disclosure:

| User application configuration Dynamic lighting by | Lighting device configuration | | |
|---|---|---|---|
| control zone | Occupancy timeout | Mode = Auto ON | Mode = Manual ON |
| Enabled | <30 min | Auto ON to dynamic lighting level and CCT Dimmer (CCT) command is | No auto ON Dimmer command is considered an override of dynamic |

-continued

| User application configuration Dynamic lighting by | Lighting device configuration | | |
|---|---|---|---|
| control zone | Occupancy timeout | Mode = Auto ON | Mode = Manual ON |
| | | considered an override of dynamic lighting<br>Auto OFF to unoccupied level and CCT continues to track with dynamic lighting | lighting<br>Auto OFF to unoccupied level and CCT continues to track with dynamic lighting |
| | Disabled | Auto ON to dynamic lighting level and CCT<br>Dimmer (CCT) command is considered an override of dynamic lighting<br>No auto OFF - dynamic lighting continues or remains at last commanded level | No Auto ON<br>Dimmer command is considered an override of dynamic lighting<br>Dynamic lighting resume command enables dynamic lighting<br>No auto OFF - dynamic lighting continues or remains at last commanded level |
| Disabled | <30 min | Default behavior for auto ON mode | Default behavior for manual ON mode |
| | Disabled | Auto ON to occupied level<br>Remains in last commanded state | No auto ON<br>Dimmer command sets the level and CCT<br>Remains in last commanded state |

Between time $t_1$ and $t_5$, the lighting device 12 calculates an updated slope for the CCT and the brightness in response to receipt of dynamic lighting instructions, but only the CCT is adjusted according to the calculated slope for the CCT while the brightness remains at the unoccupied level. Notably, even if a particular light output characteristic is not being changed by the lighting device 12 (e.g., due to an unoccupied state or a manual command from a user), the lighting device 12 continues to receive dynamic lighting instructions and calculate an updated slope for the light output characteristic in the background. This allows the lighting device 12 to seamlessly resume the dynamic lighting program at a later time, if the conditions dictate that it should do so.

At time $t_5$, the occupancy state changes from unoccupied to occupied. In response, the brightness is adjusted according to the slope calculated for the brightness (e.g., according to a first mode). In one embodiment, the brightness is immediately adjusted based on the calculated slope for the brightness. In other embodiments, some transition between the unoccupied level and a level based on the calculated slope for the brightness is performed.

Between time $t_5$ and $t_7$, an updated slope for the CCT and the brightness are calculated in response to receipt of dynamic lighting instructions and the CCT and brightness are adjusted accordingly. At time $t_7$, an override command is received from a user, causing the lighting device 12 to enter an override mode. The override command may be provided, for example, from the user application 18, a wall controller, or any other suitable means. The override command specifies a desired CCT and brightness. In response to the override command the lighting device 12 immediately adjusts the CCT and brightness of the light source 20 to the desired CCT and brightness. Between time $t_7$ and $t_{10}$, the lighting device 12 continues to calculate an updated slope for the CCT and brightness in response to receipt of dynamic lighting instructions. However, the light source 20 is not adjusted based on the calculated slope during the override mode. Instead, the light source 20 provides the light output characteristics according to the override command.

At time $t_{10}$, the occupancy state changes from occupied to unoccupied. This ends the override mode and causes the lighting device 12 to adjust the brightness to the unoccupied level and the CCT to a level specified by the last calculated slope for the CCT based on the last received dynamic lighting instructions. Between time $t_{10}$ and $t_{13}$, the lighting device 12 continues to calculate an updated slope for the CCT and brightness in response to receipt of dynamic lighting instructions. However, only the CCT is adjusted according to the calculated slope for the CCT while the brightness remains at the unoccupied level.

At time $t_{13}$ the occupancy state changes from unoccupied to occupied. In response, the brightness is adjusted according to the calculated slope for the brightness. Between time $t_{13}$ and $t_{15}$, updated slopes for the CCT and brightness are calculated in response to receipt of dynamic lighting instructions and the CCT and brightness are adjusted accordingly. At time $t_{15}$, dynamic lighting instructions are no longer received by the lighting device 12. Accordingly, the CCT and brightness are maintained at the destination state of the last received dynamic lighting instructions. At time $t_{16}$, the occupancy state changes from occupied to unoccupied. In response, the brightness is adjusted to the unoccupied level while the CCT remains unchanged. At time $t_{17}$ the occupancy state changes from unoccupied to occupied. In response, the brightness is adjusted to the brightness value in the last occupied state (just before time $t_{16}$). The CCT and brightness remain the same until time $t_{18}$, at which time the present example ends.

As illustrated above, an occupancy state may change which light output characteristics are adjusted based on the calculated slope for each light output characteristic. When the dynamic lighting instructions include destination states for a plurality of light output characteristics, each one of the plurality of light output characteristics may be adjusted according to the appropriate calculated slope when the occupancy state is occupied and only a subset of the plurality of light output characteristics may be adjusted according to the appropriate calculated slope when the occupancy state is unoccupied. For example, as illustrated above both CCT and brightness may be adjusted according to the appropriate calculated slope when the occupancy state is occupied while only CCT may be adjusted according to the calculated slope for CCT when the occupancy state is unoccupied.

As discussed above, different profile identifiers in the dynamic lighting instructions may be used to differentiate lighting devices 12 at different spatial locations within a space, and thus the destination states for each profile identifier may be constructed to create a dynamic lighting program that is coordinated across a space. In one embodiment, the destination states for each profile identifier are automatically generated to create a dynamic lighting program that is coordinated across a space.

Figure 11:
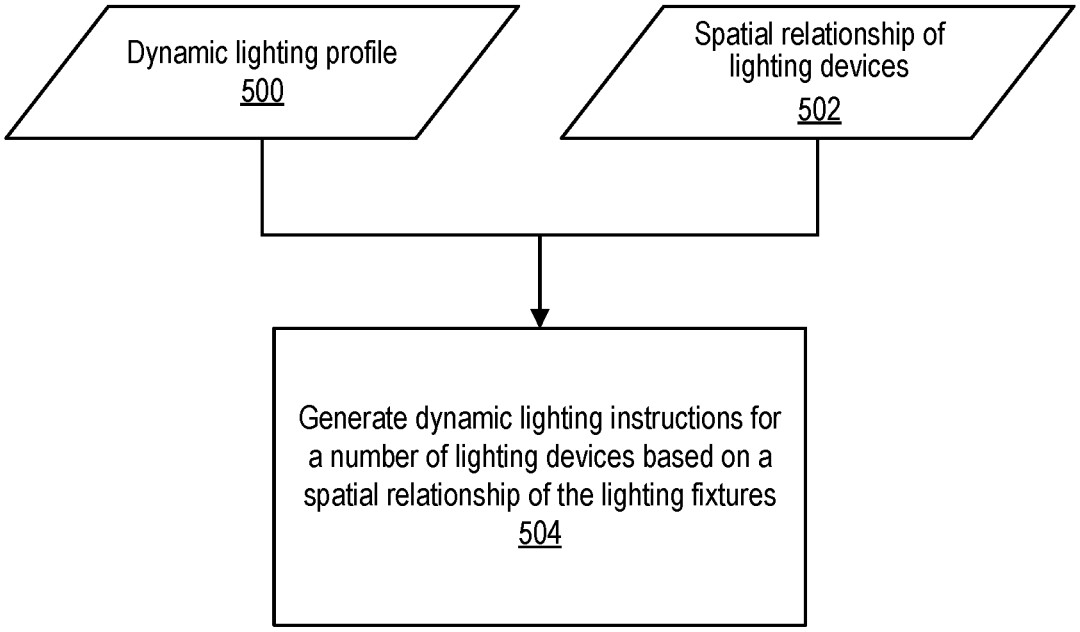
FIG. 11 illustrates a method for generating dynamic lighting instructions according to one embodiment of the present disclosure.

FIG. 11 is a flow diagram illustrating a method for generating dynamic lighting instructions to provide a dynamic lighting profile that is coordinated across a space. A dynamic lighting program (block 500) and a spatial relationship of lighting devices 12 (block 502) are received. The dynamic lighting program indicates a desired movement of light across a space over time. The spatial relationship of lighting devices 12 may include, for example, distances between the lighting devices 12, absolute locations of the lighting devices 12, relative locations of the lighting devices 12, or the like. Dynamic lighting instructions are generated for the lighting devices 12 based on the spatial relationship of the lighting devices 12 and the dynamic lighting program (block 504).

Generating the dynamic lighting instructions may include grouping lighting devices 12 into a number of profiles designated by a profile identifier based on their spatial relationships to one another, then generating destination states for each profile identifier to create a desired change in light across the space over time. In some embodiments, a lighting device 12 may have multiple profile identifiers (e.g., different profile identifiers for separate controls of different light sources 20 in the lighting device 12), or a single profile identifier may be used to provide separate control of light sources 20 in the lighting device 12. The profile identifiers may be fixed or configurable.

Figure 12A:
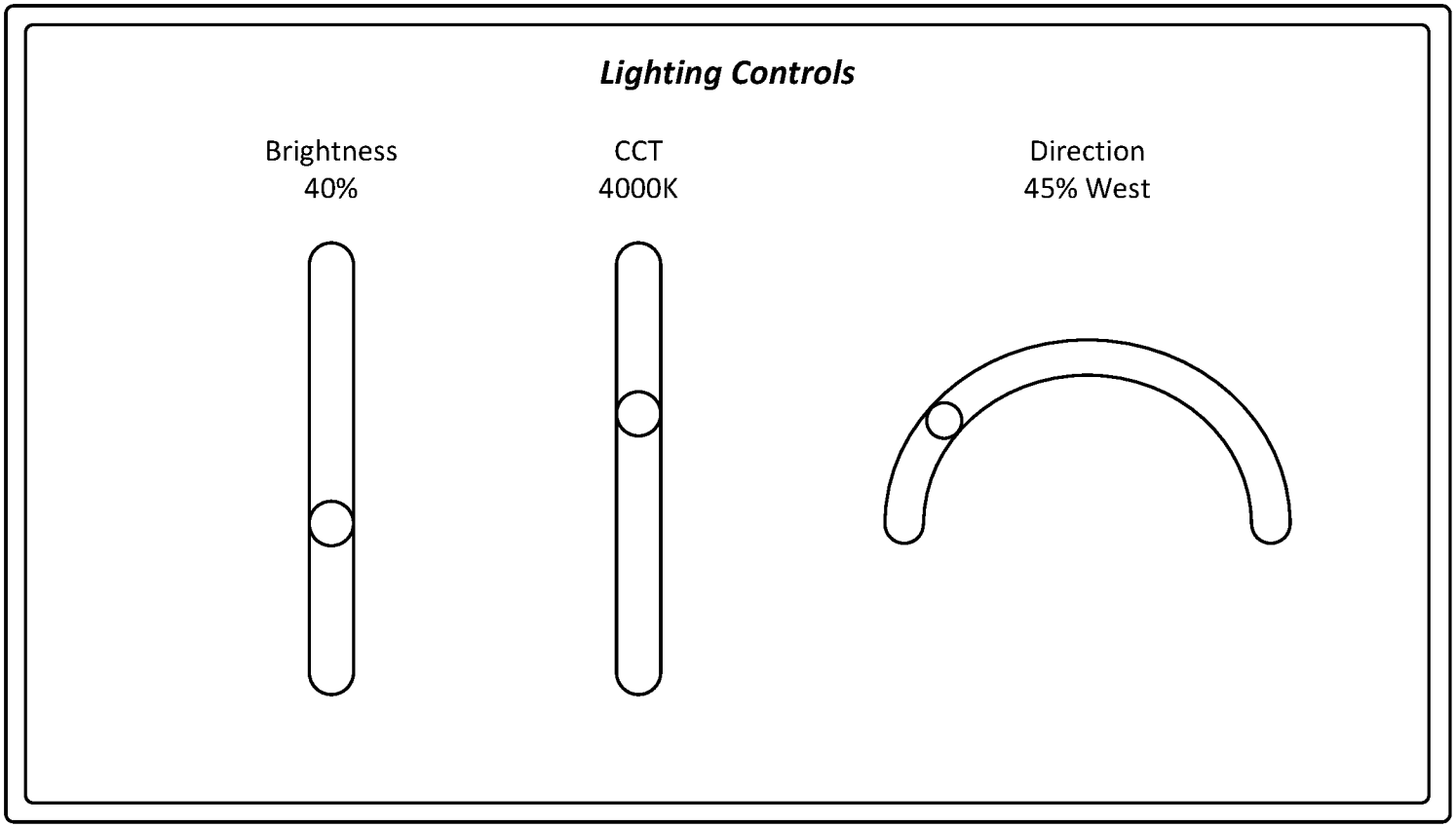
FIGS. 12A-12E illustrate user interfaces for a user application according to one embodiment of the present disclosure.
Figure 12B:
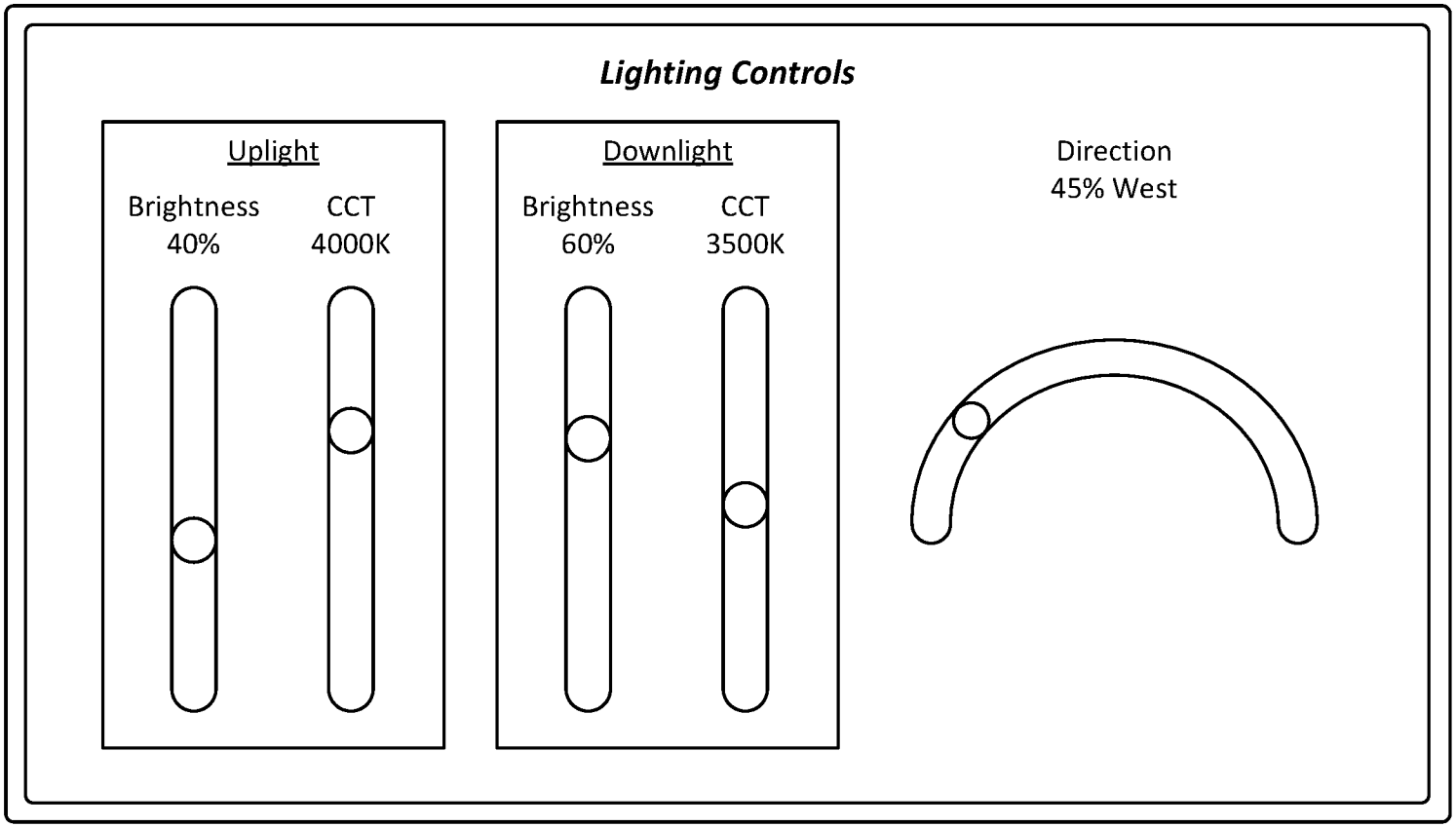
Figure 12C:
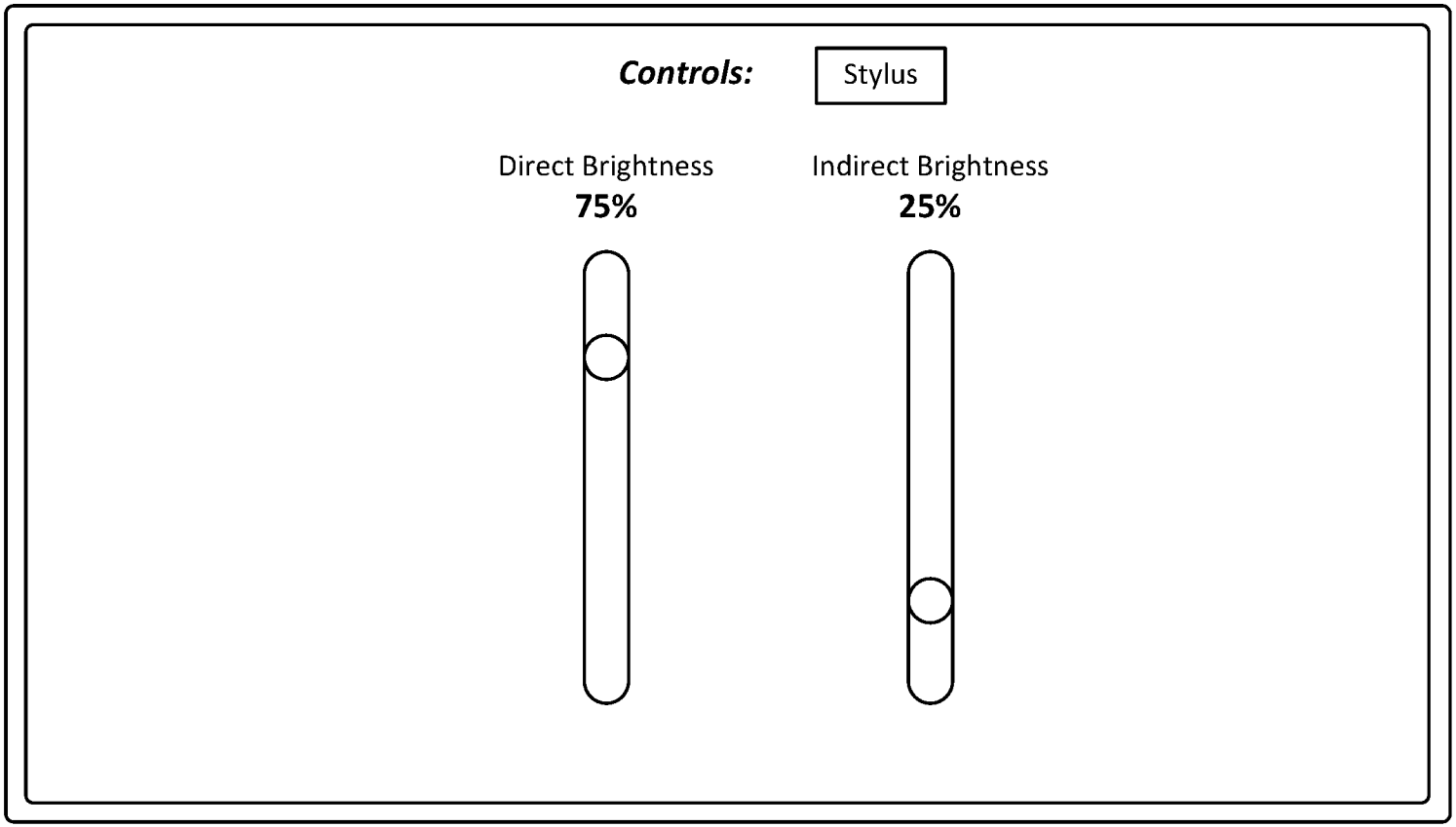

As discussed above, the user application 18 may be a software application running on a computing device such as a smartphone, a tablet, a computer, or the like. FIGS. 12A-12E illustrate exemplary user interfaces for the user application 18 according to various embodiments of the present disclosure. Specifically, FIG. 12A illustrates a first user interface for the user application 18 including controls for brightness, CCT, and directionality of light provided from one or more lighting devices 12. Notably, the user interface element for controlling the directionality of light is a slider that allows a user to change a directionality of light from a first direction to a second direction opposite the first direction. As discussed above, this user interface element may be useful for controlling the directionality of light from a skylight lighting fixture such as the one discussed above. FIG. 12B illustrates another user interface for the user application 18 that includes separate controls for different light sources 20 in one or more lighting devices 12. In this example, separate control is provided for brightness and CCT of each of an uplight (e.g., indirect light) and a downlight (e.g., direct light). The user interface further includes the slider that allows the user to change a directionality of light as in FIG. 12A. FIG. 12C illustrates another user interface for the user application 18 that includes separate controls for the different light sources 20 as in FIG. 12B. In this example, a group of lighting devices 12 may be selected (e.g., by profile identifier) and simplified controls for brightness adjustments are presented.

Figure 12D:
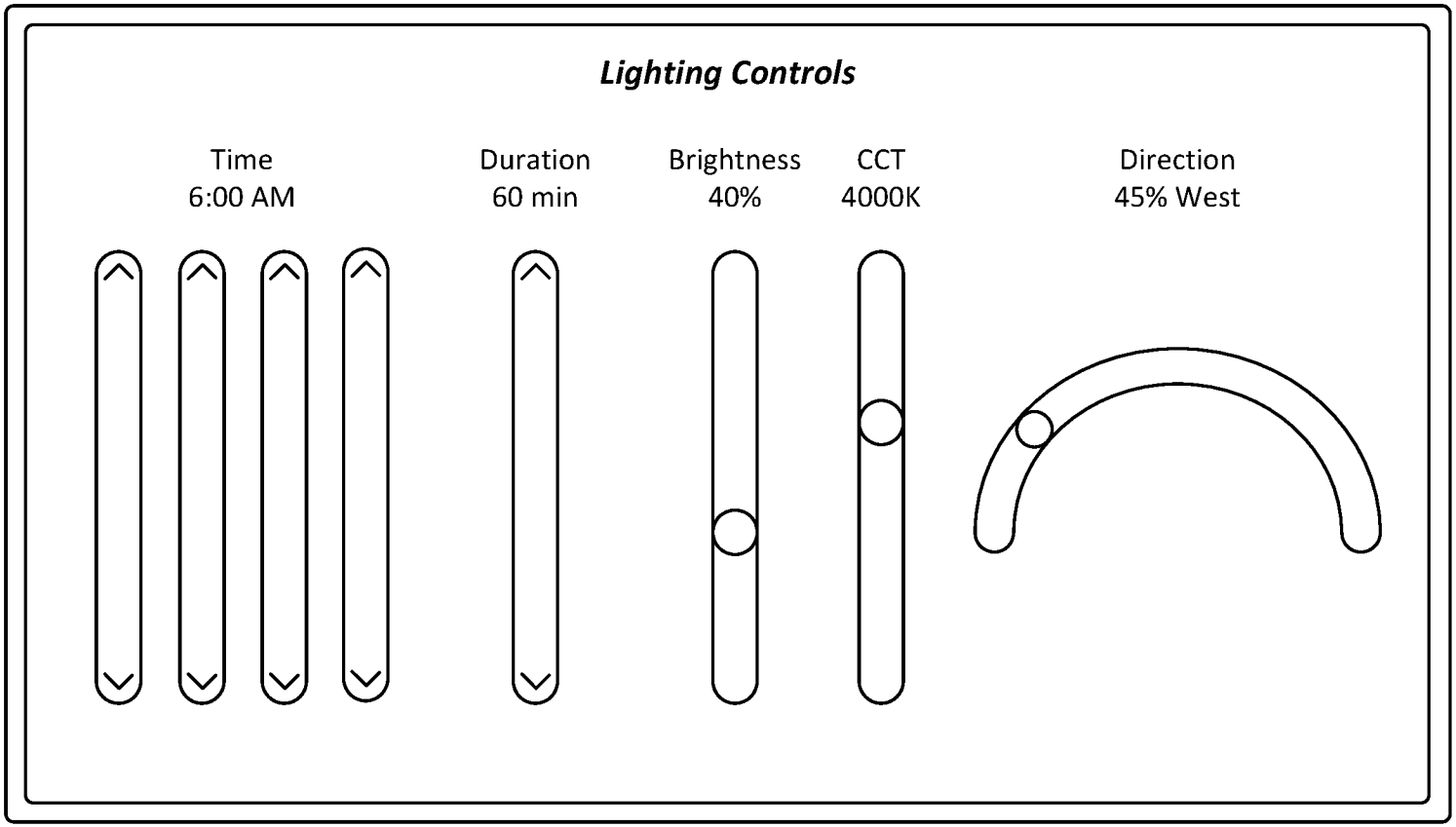
Figure 12E:
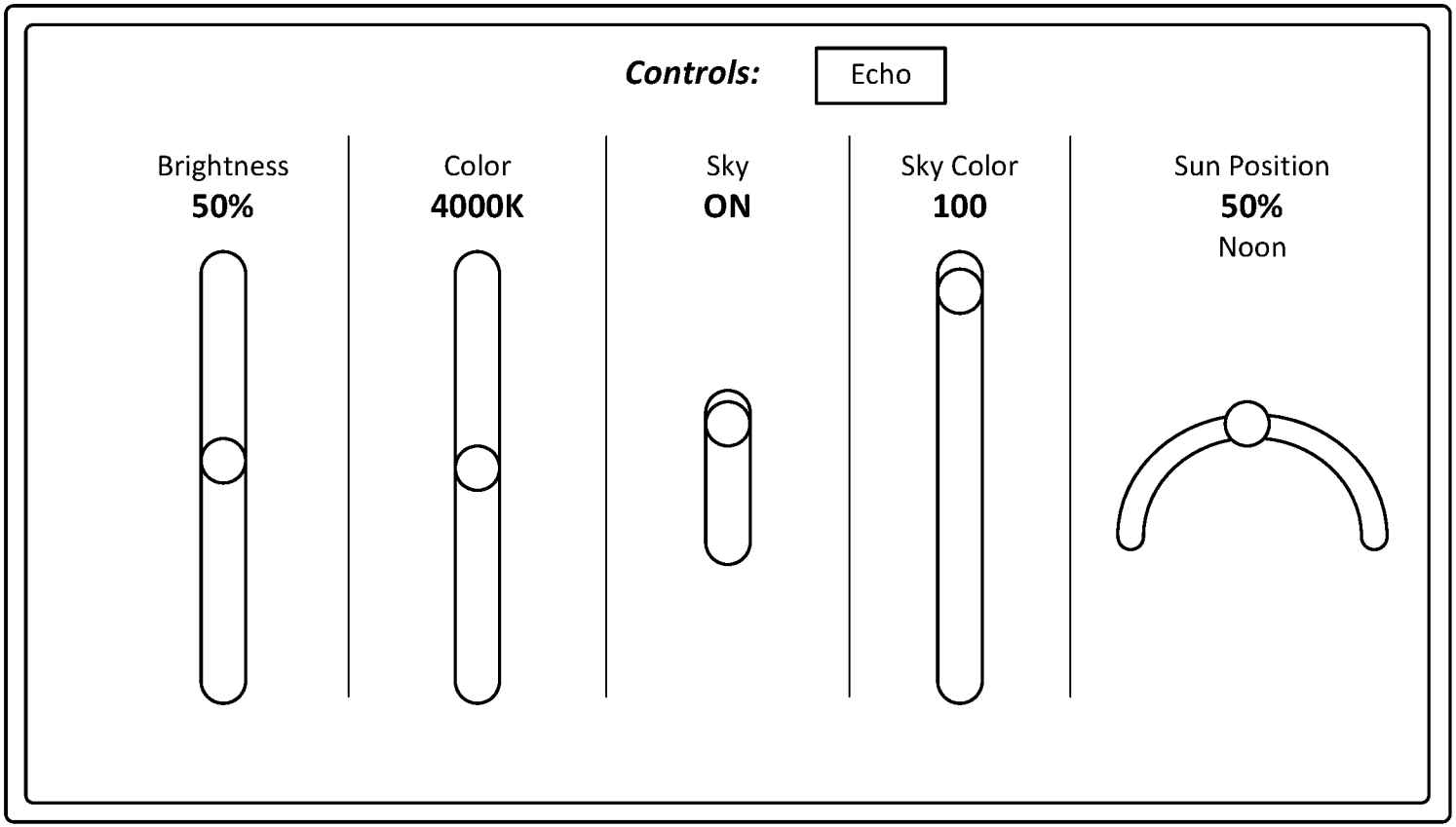

FIG. 12D illustrates a user interface for the user application 18 including controls for creating dynamic lighting instructions according to one embodiment of the present disclosure. The user interface includes controls for a start time, a duration, a brightness, CCT, and directionality of light. The start time determines what time the dynamic lighting instructions are sent to the lighting devices 12 for which the dynamic lighting instructions are intended. The duration indicates the transition duration, and the controls for brightness, CCT, and directionality indicate the destination states for these light output characteristics. By providing several of these inputs, a desired dynamic lighting program can be created. FIG. 12E illustrates another user interface for the user application 18 including controls for creating dynamic lighting instructions according to one embodiment of the present disclosure. The user interface includes controls for brightness, CCT, sky emulation state (on/off), sky emulation color, and directionality of light.

Figure 13A:
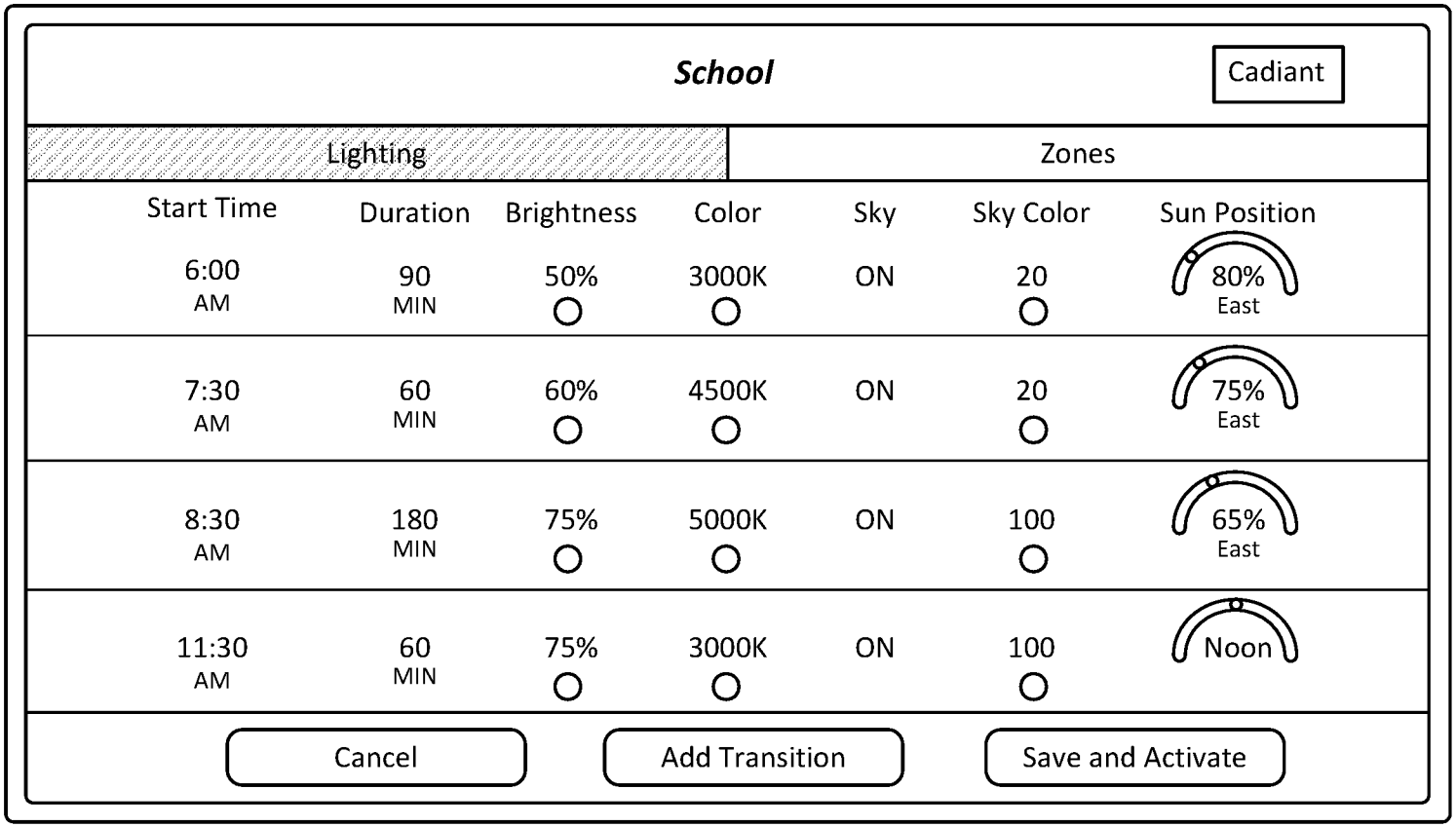
FIGS. 13A and 13B illustrate creation of multiple lighting control profiles, which may be used by the intelligent lighting coordinator to provide dynamic lighting according to another embodiment of the present disclosure.
Figure 13B:
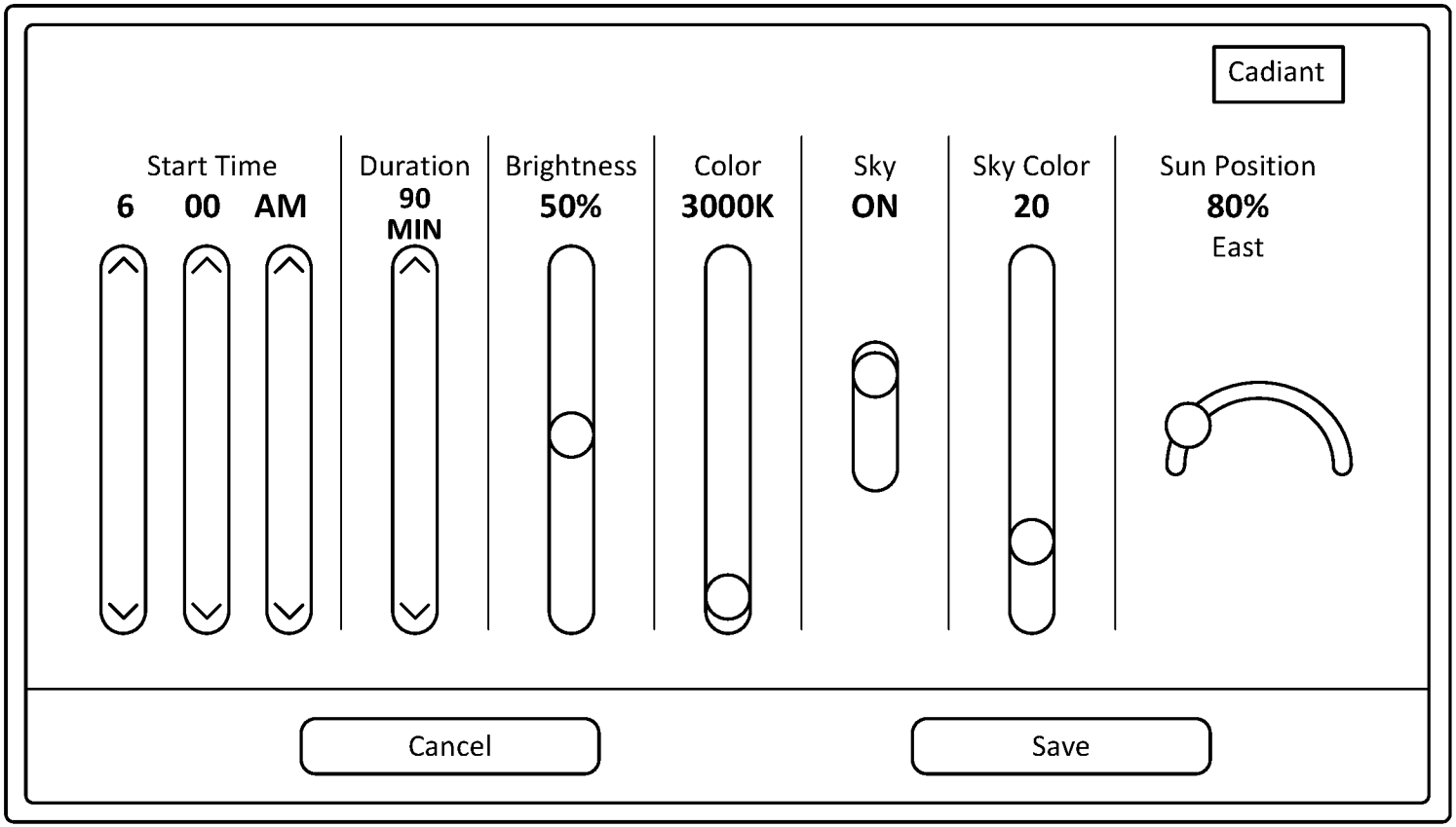

FIGS. 13A and 13B illustrate creation of multiple lighting control profiles, which may be used by the intelligent lighting coordinator 14 to provide dynamic lighting according to another embodiment of the present disclosure. In particular, FIG. 13A illustrates a user interface with a number of lighting control profiles for dynamically adjusting one or more lighting devices at different intervals. Each profile includes a start time, duration, brightness, CCT, sky emulation state, sky color, and directionality (e.g., sun position). As illustrated, a series of transitions are programed for adjusting one or more lighting devices 12 throughout each day. FIG. 13B illustrates a user interface for creating or adjusting one of the lighting control profiles of FIG. 13A. The user interface includes controls for a start time, a duration, a brightness, CCT, sky emulation state (on/off), sky emulation color, and directionality of light.

Those skilled in the art will recognize improvements and modifications to the preferred embodiments of the present disclosure. All such improvements and modifications are considered within the scope of the concepts disclosed herein and the claims that follow.

What is claimed is:

1. A lighting device, comprising:

a light source;

communications circuitry;

driver circuitry configured to control the light source;

processing circuitry coupled to the light source and the communications circuitry; and a memory coupled to the processing circuitry, the memory storing instructions, which, when executed by the processing circuitry cause the lighting device to:

receive dynamic lighting instructions via the communications circuitry, the dynamic lighting instructions including transition information;

in response to receiving the dynamic lighting instructions, determine a light output function for changing a light output characteristic of the light source based on the transition information;

store a light output characteristic variable; and adjust the light output characteristic variable for controlling the light source over time such that the light output characteristic transitions from its current state based on the light output function.

2. The lighting device of claim 1, wherein the memory includes further instructions, which, when executed by the processing circuitry cause the lighting device to:

receive updated dynamic lighting instructions via the communications circuitry, the updated dynamic lighting instructions including updated transition information;

in response to receiving the updated dynamic lighting instructions, determine an updated light output function for changing the light output characteristic of the light source based on the updated transition information; and adjust the light output characteristic variable for controlling the light source over time such that the light output characteristic transitions from its current state based on the updated light output function.

3. The lighting device of claim 1, wherein:

the transition information comprises a destination state for the light output characteristic of the light source and a transition duration; and determining the light output function for changing the light output characteristic of the light source based on the transition information comprises calculating the light output function from the destination state and the transition duration.

4. The lighting device of claim 3, wherein calculating the light output function for changing the light output characteristic comprises:

determining a difference between the current state and the destination state;

determining a number of steps between the current state and the destination state based on a minimum adjustment value associated with the light source and the difference between the current state and the destination state; and determining a change interval for changing the light output characteristic by the minimum adjustment value to transition from the current state to the destination state over the transition duration.

5. The lighting device of claim 1, wherein:

the transition information comprises a destination state for the light output characteristic of the light source and a transition end time; and determining the light output function for changing the light output characteristic of the light source based on the transition information comprises calculating the light output function from the destination state and the transition end time.

6. The lighting device of claim 1, wherein the transition information comprises the light output function and one or more of a transition duration, a destination state, or a transition end time.

7. The lighting device of claim 1, wherein:

the dynamic lighting instructions include transition information for a plurality of light output characteristics of the light source; and the memory includes further instructions, which, when executed by the processing circuitry cause the lighting device to:

for each one of the plurality of light output characteristics, determine a corresponding light output function for changing the one of the plurality of light output characteristics based on the transition information; and for each one of the plurality of light output characteristics, adjust a corresponding light output characteristic variable for controlling the light source over time such that the one of the plurality of light output characteristics transitions from its current state based on the corresponding light output function.

8. The lighting device of claim 7, wherein the plurality of light output characteristics comprises two or more of brightness, correlated color temperature, sky emulation color, sun emulation position, or modulation information.

9. The lighting device of claim 1, wherein:

in a first mode, the driver circuitry is configured to control the light source in accordance with the stored light output characteristic variable; and in a second mode:

the driver circuitry is configured not to control the light source in accordance with the stored light output characteristic variable; and the processing circuitry continues to cause the lighting device to adjust the light output characteristic variable over time based on the light output function.

10. The lighting device of claim 9, wherein:

the second mode is an inactive mode; and in the inactive mode, the driver circuitry maintains the light source inactive.

11. The lighting device of claim 9, wherein the memory includes further instructions, which, when executed by the processing circuitry cause the lighting device to:

receive an override command, the override command including a desired state for the light output characteristic; and in response to receiving the override command, enter an override mode wherein the driver circuitry controls the light source based on the desired state.

12. The lighting device of claim 11, wherein the memory includes further instructions, which, when executed by the processing circuitry cause the lighting device to:

exit the override mode in response to an event; and in response to exiting the override mode, resume the first mode.

13. A method for providing dynamic lighting, the method comprising:

receiving dynamic lighting instructions at a lighting device, the dynamic lighting instructions including transition information, wherein the transition information comprises a destination state for the light output characteristic of the light source and at least one of a transition duration or a transition end time;

in response to receiving the dynamic lighting instructions at the lighting device, determining a light output function for changing a light output characteristic of a light source based on the transition information by calculating the light output function from the destination state and the at least one of the transition duration or the transition end time; and adjusting, over time, a light output characteristic variable for controlling the light source such that the light output characteristic transitions from its current state based on the light output function.

14. The method of claim 13 wherein the dynamic lighting instructions include transition information for a plurality of light output characteristics of the light source and the method further comprises:

for each one of the plurality of light output characteristics, determining a corresponding light output function for changing the one of the plurality of light output characteristics based on the transition information; and for each one of the plurality of light output characteristics, adjusting, over time, a corresponding light output characteristic variable for controlling the light source such that the one of the plurality of light output characteristics transitions from its current state based on the corresponding light output function.

15. The method of claim 13, further comprising:

receiving updated dynamic lighting instructions, the updated dynamic lighting instructions including updated transition information;

in response to receiving the updated dynamic lighting instructions, determining an updated light output function for changing the light output characteristic of the light source based on the updated transition information; and adjusting, over time, the light output characteristic variable for controlling the light source such that the light output characteristic transitions from its current state based on the updated light output function.

16. The method of claim 13, wherein calculating the light output function for changing the light output characteristic comprises:

determining a difference between the current state and the destination state;

determining a number of steps between the current state and the destination state based on a minimum adjustment value associated with the light source and the difference between the current state and the destination state; and determining a change interval for changing the light output characteristic by the minimum adjustment value to transition from the current state to the destination state over the transition duration.

17. The method of claim 13, further comprising:

storing the light output characteristic variable;

in a first mode, controlling the light source in accordance with the stored light output characteristic variable; and in a second mode:

not controlling the light source in accordance with the light output characteristic variable; and continuing to adjust the light output characteristic variable over time based on the light output function.

18. A lighting device, comprising:

a light source;

communications circuitry;

processing circuitry coupled to the light source and the communications circuitry; and a memory coupled to the processing circuitry, the memory storing instructions, which, when executed by the processing circuitry cause the lighting device to:

receive dynamic lighting instructions via the communications circuitry, the dynamic lighting instructions including a light output function for changing a light output characteristic of the light source and one or more of a transition duration, a destination state, or a transition end time; and adjust a light output characteristic variable for controlling the light source over time such that the light output characteristic transitions from its current state based on the light output function.

19. The lighting device of claim 18, wherein the memory includes further instructions, which, when executed by the processing circuitry cause the lighting device to:

receive updated dynamic lighting instructions via the communications circuitry, the updated dynamic lighting instructions including updated transition information;

in response to receiving the updated dynamic lighting instructions, determine an updated light output function for changing the light output characteristic of the light source based on the updated transition information; and adjust the light output characteristic variable for controlling the light source over time such that the light output characteristic transitions from its current state based on the updated light output function.

20. The lighting device of claim 18, wherein adjusting the light output characteristic variable comprises:

determining a difference between the current state and the destination state;

determining a number of steps between the current state and the destination state based on a minimum adjustment value associated with the light source and the difference between the current state and the destination state; and determining a change interval for changing the light output characteristic by the minimum adjustment value to transition from the current state to the destination state over the transition duration.

* * * * *